US012054942B2

(12) United States Patent
Bickford et al.

(10) Patent No.: US 12,054,942 B2
(45) Date of Patent: Aug. 6, 2024

(54) TEMPORARY WALL SYSTEM WITH FIRE BLOCK PROTECTION

(71) Applicant: STARC Systems, Inc., Brunswick, ME (US)

(72) Inventors: Bruce Bickford, Cushing, ME (US); Timothy Hebert, Yarmouth, ME (US); Darrell Flagg, Turner, ME (US); William Randall, Brunswick, ME (US)

(73) Assignee: STARC Systems, Inc., Brunswick, ME (US)

( * ) Notice: Subject to any disclaimer, the term of this patent is extended or adjusted under 35 U.S.C. 154(b) by 114 days.

(21) Appl. No.: 17/527,597

(22) Filed: Nov. 16, 2021

(65) Prior Publication Data

US 2022/0178138 A1 Jun. 9, 2022

Related U.S. Application Data

(60) Provisional application No. 63/122,776, filed on Dec. 8, 2020.

(51) Int. Cl.
*E04B 2/74* (2006.01)
*E04B 2/72* (2006.01)
*E04G 21/24* (2006.01)

(52) U.S. Cl.
CPC ..... *E04B 2/721* (2013.01); *E04B 2/7403* (2013.01); *E04B 2/7411* (2013.01); (Continued)

(58) Field of Classification Search
CPC ..... E04B 2/721; E04B 2/7448; E04B 2/7407; E04B 2/7409; E04B 2/7411; E04B 2/7425; E04B 2/7401; E04B 2/7403; E04B 2/7422; E04B 2/16141; E04B 2103/04; E04B 2002/0204; E04B 2002/0206; E04B 2002/0208; E04B 2002/0213; E04B 2002/0215; E04B 2002/0217;
(Continued)

(56) References Cited

U.S. PATENT DOCUMENTS 2,647,287 A * 8/1953 Jones ..... E04B 1/34321 D25/33
2,855,037 A 10/1958 Stiffel
(Continued)

*Primary Examiner* — Kyle J. Walraed-Sullivan
(74) *Attorney, Agent, or Firm* — Crowe & Dunlevy LLC; Andre M. Szuwalski

(57) ABSTRACT

A barrier system for partitioning a space includes panels which interlock with each other to provide a barrier that is fire rated. The interlocking panels are assembled in the barrier in columns using a tongue and groove assembly and a panel lock using a strike and latch supported by the tongue member and groove member, respectively. Each panel includes a peripheral frame (that is shaped to provide the tongue and groove members), opposed steel side faces mounted to the peripheral frame, and an insulation block filling an interior space delimited by the peripheral frame and the opposed steel side faces. The insulation block includes a pair of insulating material layers that sandwich a radiant barrier layer. A floor module supports a bottom edge of the panel and an interface module supports a side/top edge of the panel. The floor/interface modules are configured with telescoping sections and are length trimmable.

33 Claims, 12 Drawing Sheets

(52) U.S. Cl.
CPC ..... *E04B 2/7448* (2013.01); *E04G 21/243* (2013.01); *E04B 2103/04* (2013.01)

(58) Field of Classification Search
CPC ..... E04B 2002/0219; E04B 2002/0221; E04B 2002/0223; E04B 2002/0226; E04B 2002/0228; E04B 2002/0232; E04B 2002/0234; E04B 2002/0236; E04B 2002/0239; E04B 2002/0241; E04B 2002/0243; E04B 2002/0245; E04B 2002/0247; E04B 2002/025; E04B 2002/0252; E04B 2002/0254; E04B 1/34321; E04B 1/14; E04B 1/6125; E04B 1/6158; E04B 1/6166; E04B 1/617; E04B 1/6175; E04B 1/6179; E04B 2002/021; E04C 2/292; E04C 2/296
See application file for complete search history.

(56) References Cited

U.S. PATENT DOCUMENTS 3,332,182 A * 7/1967 Mark ..... E04B 2/7453 411/116
3,593,474 A 7/1971 Neels
3,596,701 A 8/1971 Cowan
3,685,223 A 8/1972 Sherwood
3,731,956 A * 5/1973 Hanley ..... E04B 1/6116 403/380
3,897,668 A 8/1975 McDonnell
4,144,924 A 3/1979 Vanden Hoek
4,236,366 A * 12/1980 Rijnders ..... E04B 1/6133 52/592.1
4,245,442 A 1/1981 Durham
4,251,969 A * 2/1981 Bains ..... B66B 11/0253 52/584.1
4,266,386 A * 5/1981 Bains ..... F16B 5/0036 52/481.2
4,277,920 A 7/1981 Dixon
4,535,577 A 8/1985 Tenser et al.
4,546,889 A 10/1985 Schoumaker et al.
4,706,551 A 11/1987 Schofield
4,731,961 A 3/1988 Bona
4,833,840 A 5/1989 Kalischewski et al.
5,038,535 A * 8/1991 Van Praag, III ..... E04D 13/08 403/DIG. 1
5,054,255 A 10/1991 Maninfior
5,088,511 A 2/1992 Bain
5,125,202 A 6/1992 Kissinger
5,373,678 A * 12/1994 Hesser ..... E04C 2/292 52/592.1
5,424,118 A * 6/1995 McLaughlin ..... E05C 3/004 428/318.6
5,433,046 A 7/1995 MacQuarie et al.
5,452,925 A * 9/1995 Huang ..... E05B 65/0817 292/65
5,457,922 A 10/1995 Fara
5,475,960 A * 12/1995 Lindal ..... E04B 1/72 52/745.1
5,480,117 A * 1/1996 Fleming, III ..... E05B 9/08 52/584.1
5,509,242 A * 4/1996 Rechsteiner ..... E04C 2/296 52/287.1
5,685,112 A 11/1997 Fara
5,797,440 A * 8/1998 Tsai ..... E04B 2/7425 52/584.1
5,803,653 A 9/1998 Zuffetti
5,816,001 A 10/1998 Goodman et al.
5,924,469 A 7/1999 Whittemore
6,122,879 A * 9/2000 Montes ..... E04F 13/0876 52/592.4
6,171,705 B1 1/2001 Clifforde
6,266,939 B1 7/2001 Yates et al.
6,383,242 B1 5/2002 Rogers et al.
6,435,253 B1 8/2002 Steeves et al.
6,662,502 B2 12/2003 Janutta et al.
6,729,085 B2 5/2004 Newhouse et al.
7,188,636 B1 3/2007 Kanne et al.
7,461,484 B2 12/2008 Battey et al.
7,810,771 B1 10/2010 Akers et al.
8,046,957 B2 11/2011 Towersey et al.
8,074,700 B1 12/2011 Melino et al.
8,181,404 B2 5/2012 Klein
8,839,592 B2 9/2014 Foran
8,875,772 B1 11/2014 Dixon, Jr.
8,875,774 B1 11/2014 Flores
8,915,033 B2 12/2014 Daniels et al.
9,151,045 B2 10/2015 Huang
10,036,157 B2 7/2018 Segall
10,041,249 B1 8/2018 Hebert et al.
10,072,411 B1 9/2018 Moran et al.
10,246,873 B1 * 4/2019 Costanza ..... B32B 21/047
10,287,770 B2 5/2019 Hodson et al.
10,329,759 B2 6/2019 Feldpausch et al.
10,557,262 B2 2/2020 Moran et al.
10,774,527 B2 9/2020 Harber et al.
10,775,072 B2 9/2020 Duchet et al.
2002/0148178 A1 10/2002 Farag
2002/0152703 A1 10/2002 Dunks
2003/0024189 A1 2/2003 Hughes et al.
2003/0126814 A1 * 7/2003 Cook ..... E04C 2/296 52/794.1
2004/0065799 A1 4/2004 Whittemore et al.
2006/0283562 A1 12/2006 Hickey
2009/0020242 A1 1/2009 Muhlebach
2009/0133354 A1 5/2009 Spear et al.
2009/0307990 A1 12/2009 Muehlebach
2010/0058688 A1 3/2010 Goddard
2010/0307080 A1 * 12/2010 Parshad ..... E04B 2/7425 52/239
2011/0078960 A1 4/2011 Luttmann
2011/0138719 A1 6/2011 Gosling et al.
2011/0162293 A1 7/2011 Levy et al.
2011/0173925 A1 * 7/2011 Brown ..... F25D 23/06 52/794.1
2012/0006498 A1 1/2012 Potter
2012/0167371 A1 7/2012 Mateu Climent
2014/0033642 A1 2/2014 Foran
2014/0075851 A1 3/2014 Rhines et al.
2016/0356039 A1 * 12/2016 Del Missier ..... E04B 2/7401
2018/0355607 A1 * 12/2018 Parshad ..... E04B 2/08
2019/0271148 A1 * 9/2019 Hodson ..... E04C 2/2885
2020/0096251 A1 * 3/2020 Costanza ..... E04B 1/6125
2021/0238845 A1 * 8/2021 Bickford ..... B32B 9/041
2021/0333042 A1 * 10/2021 Gingras ..... E04B 1/6179
2021/0395994 A1 12/2021 Kolisnek
2022/0178138 A1 * 6/2022 Bickford ..... E04B 2/721
2023/0167636 A1 * 6/2023 Keller ..... E04B 1/14 52/91.3

* cited by examiner

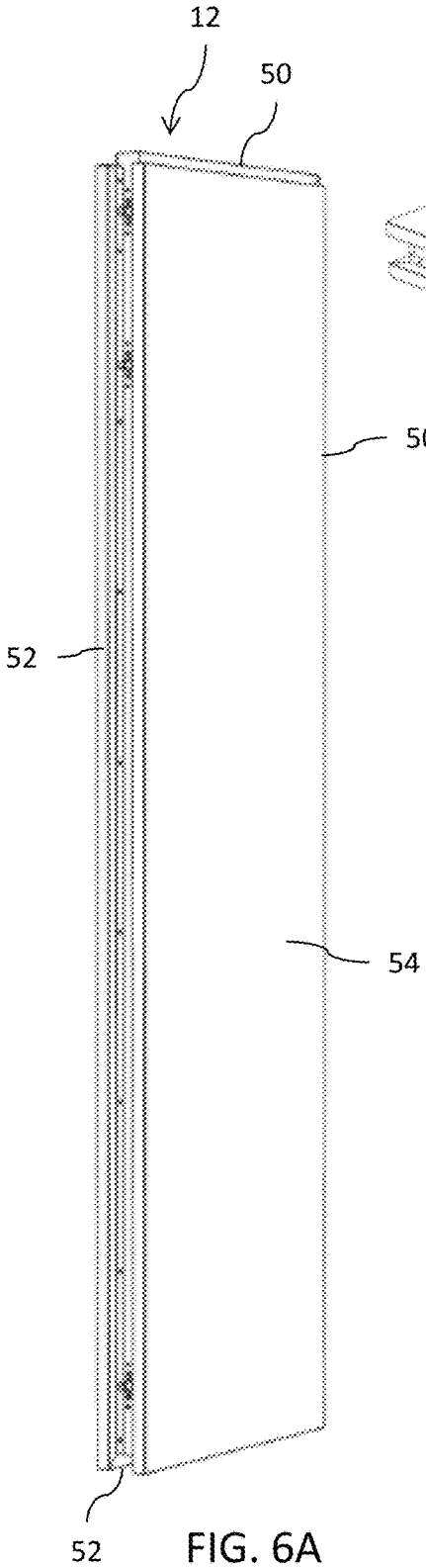
FIG. 6A
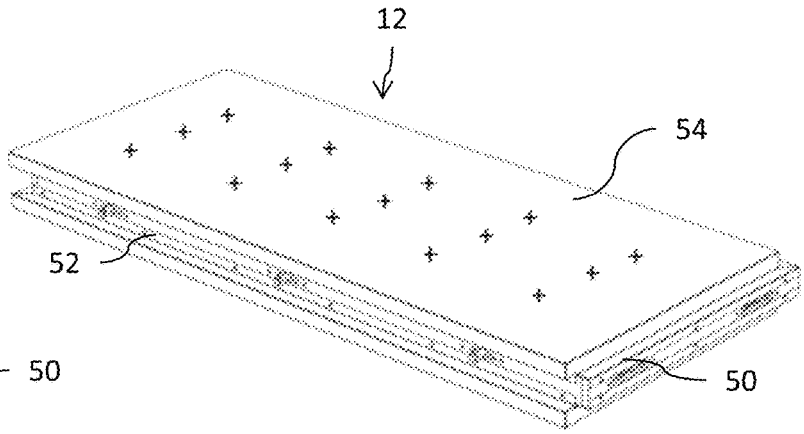
FIG. 6B
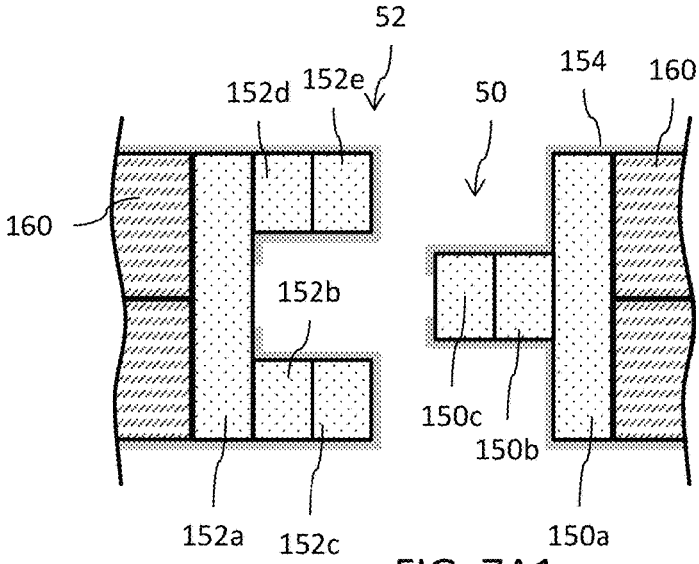
FIG. 7A1
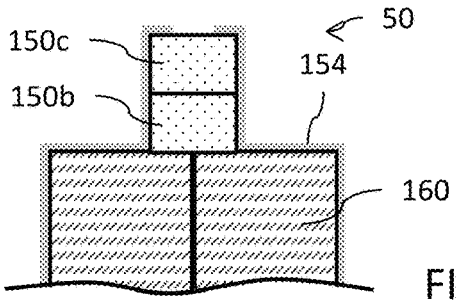
FIG. 7A3

FIG. 7A2

TEMPORARY WALL SYSTEM WITH FIRE BLOCK PROTECTION

CROSS-REFERENCE TO RELATED APPLICATION

This application claims priority from U.S. Provisional Application for Patent No. 63/122,776, filed Dec. 8, 2020, the disclosure of which is incorporated by reference.

TECHNICAL FIELD

The present invention generally relates to temporarily installed barriers for use in partitioning a space in construction and remodeling projects and, more particularly, to a system for temporary containment that provides a fire, smoke and sound barrier.

BACKGROUND

During the construction or remodeling of a building interior it is often desirable to temporarily partition the space. In one conventional solution, a temporary barrier is constructed. The temporary barrier may be a soft barrier (such as a plastic sheet) or hard barrier (comprising a light duty wall constructed on site from wood or gypsum panels mounted to a frame which is attached to the walls, ceiling and floor). A further advancement in the art provides for the installation of a prefabricated barrier that is reusable following completion of the project. An example of this is described in U.S. Pat. No. 10,041,249 and U.S. application for patent Ser. No. 17/155,747, filed Jan. 22, 2021 (both of which are incorporated herein by reference).

When a building is occupied and a remodel is being performed, it is conventional for building and fire code regulations to require the presence of a barrier between the occupied and remodel spaces that will provide for a level of fire and smoke protection (see, for example, ASTM E-84 and E-119 performance requirements). Providing this level of protection can be a challenge. There is a need in the art for a temporary rated protection barrier which is prefabricated and reusable and which provides a level of fire block protection.

SUMMARY

In an embodiment, A barrier system for partitioning a space comprises: a plurality of interlocking panels forming a barrier; wherein the interlocking panels are assembled laterally adjacent to each other in the barrier; wherein a connection of laterally adjacent interlocking panels in the barrier is made through a joint formed by a tongue and groove assembly. The tongue and groove assembly comprises: on a first interlocking panel, a latch plate and a connector mounted to the latch plate which includes a head; and on a second interlocking panel, a strike plate including a slot with an end having a wider opening configured to receive the head and a middle having a narrower opening configured to engage the head.

In an embodiment, an interlocking panel for use in a barrier system for partitioning a space comprises: a peripheral frame; opposed steel side faces mounted to the peripheral frame; and an insulation block filling an interior space delimited by the peripheral frame and the opposed steel side faces. The peripheral frame includes a tongue and groove assembly comprising: on a first edge of the interlocking panel, a latch plate and a connector mounted to the latch plate which includes a head; and on a second edge of the interlocking panel, a strike plate including a slot with an end having a wider opening configured to receive the head and a middle having a narrower opening configured to engage the head.

In an embodiment, a barrier system for partitioning a space includes panels which interlock with each other to provide a fire rated barrier. The interlocking panels are assembled in the barrier in laterally adjacent columns using a tongue and groove assembly and a panel lock using a strike and latch supported by the tongue member and groove member, respectively. Each panel includes a peripheral frame (that is shaped to provide the tongue and groove members), opposed steel side faces mounted to the peripheral frame, and an insulation block filling an interior space delimited by the peripheral frame and the opposed steel side faces. The insulation block includes a pair of insulating material layers that sandwich a radiant barrier layer. A floor module supports a bottom edge of the panel and an interface module supports a side/top edge of the panel. The floor/interface modules are configured with telescoping sections and are length trimmable.

BRIEF DESCRIPTION OF THE DRAWINGS

For a better understanding of the embodiments, reference will now be made by way of example only to the accompanying figures in which:

FIGS. 6A and 6B show perspective views of an individual panel;

FIGS. 7A1 and 7A2 are cross sectional views showing the tongue and groove configuration of the panels in a disconnected and connected relationship, respectively;

FIG. 7A3 is a cross sectional view showing an alternate embodiment of the tongue configuration of the panels;

DETAILED DESCRIPTION

Figure 1:
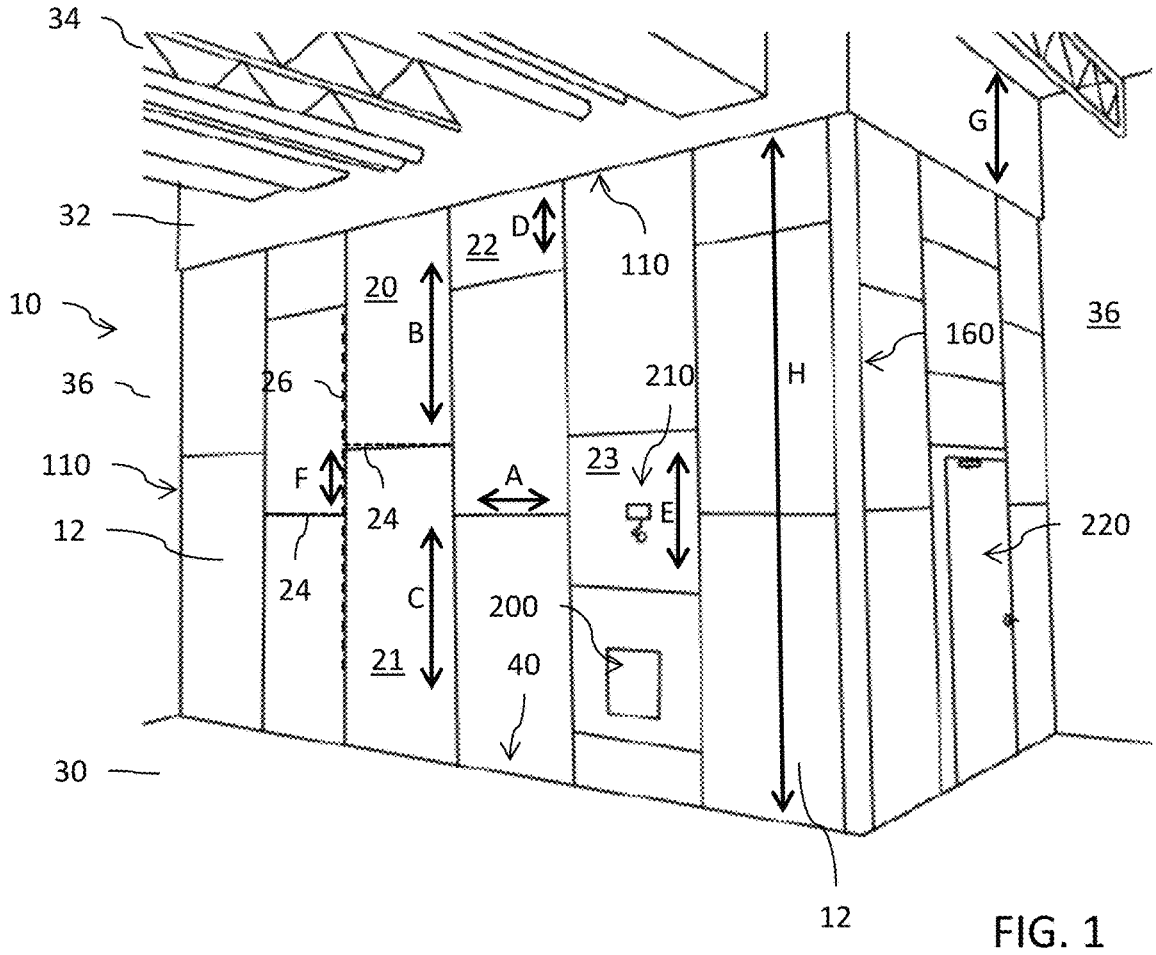
FIGS. 1, 2 and 3 each illustrate a section of a temporary barrier, with FIG. 1 showing installation of the temporary barrier in a space.
Figure 2:
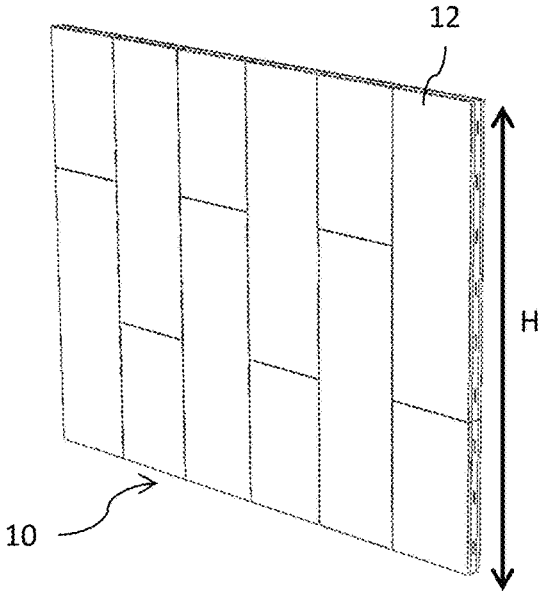
Figure 3:
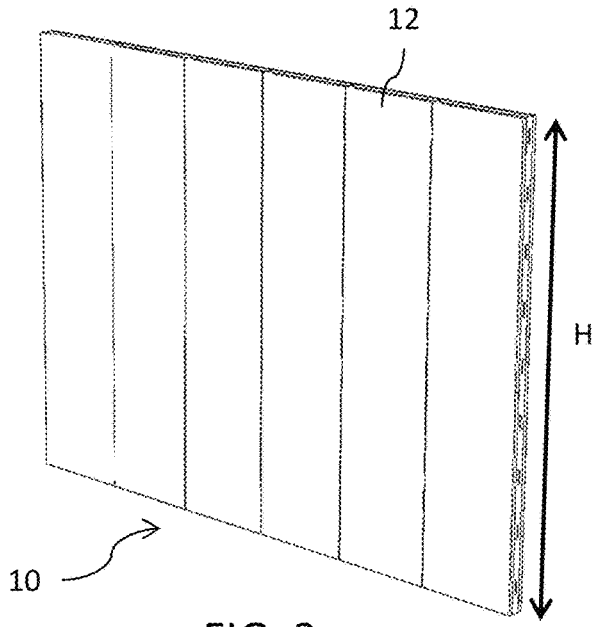

Reference is now made to FIGS. 1, 2 and 3 each of which illustrates a section of a temporary barrier 10, with FIG. 1 showing installation of the barrier to partition a space. The barrier 10 is formed by a plurality of panels 12. Each panel 12 has a same thickness. The panels 12 can be provided in a number of different dimensions. Examples of such dimensions as shown in FIG. 1 include: a panel 20 with a dimension A×B, another panel 21 with a dimension of A×C, a further panel 22 with a dimension A×D and yet another panel 23 with a dimension of A×E. In FIGS. 1 and 2, the size of the panels 12 is insufficient for one panel alone to cover the full height H of the space and so two (or more) panels are vertically stacked to cover the needed height. Here, the stacked installation of the panels 12 advantageously provides for vertically offset horizontal joints 24 with respect to two adjacent columns of panels sharing a common vertical joint 26. The minimum amount of spacing F between two horizontal joints 24 is dependent on the frame/panel stiffness, adhesive shear strength, core bending and other shear properties of the panels. In FIG. 3, however, the panels 12 are sized so that one panel alone is sufficient to cover the full height H of the space.

Figure 4A:
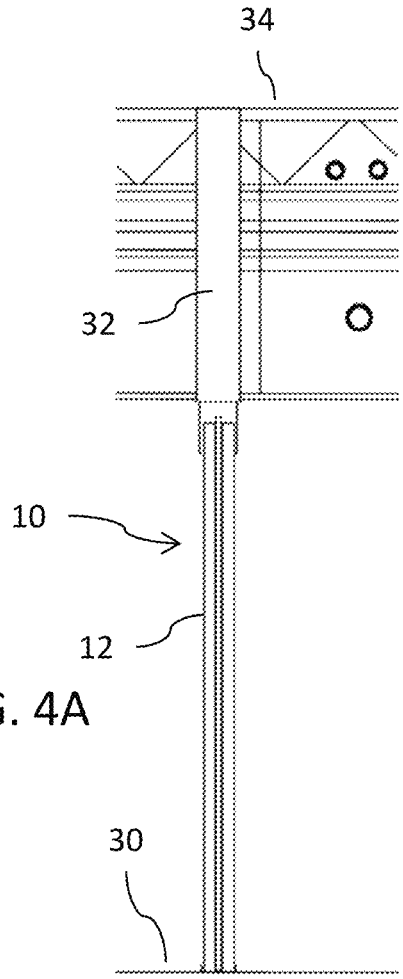
FIGS. 4A and 4B are cross sectional views showing installation of the temporary barrier in the space.
Figure 4B:
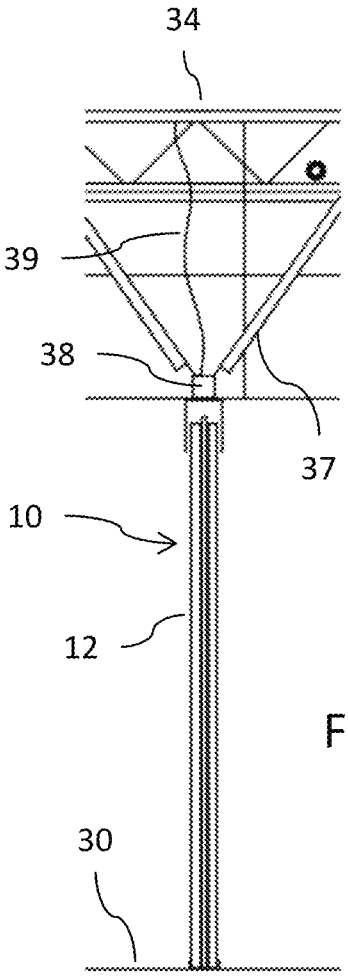

The barrier 10 is installed in the space between the floor 30 and the soffit 32 which is constructed under the floor deck (ceiling) 34, and the barrier 10 may be attached to, and extend away from, existing walls 36 in the space. The configuration of the constructed soffit 32 accounts for the presence of structural, electrical, plumbing, heating, air conditioning and other equipment, and the depth G of the soffit 32 must take into account the height dimensions of the panels so that the bottom of the soffit can interface with a top of the top-most panel using an integer number of vertically stacked panels (of selected dimensional sizes) providing the height H. FIGS. 4A and 4B show cross-sectional views through the barrier 10 as installed within the space. The illustration in FIG. 4A generally conforms to the installation as shown in FIG. 1 where the barrier extends between the floor 30 and the soffit 32. FIG. 4B shows an alternative installation where a soffit is not installed and the top of the barrier is instead secured by bracing 37 extending from a connector 38 at the top of the barrier to the underside of the floor deck (ceiling) 34. A flame-retardant plastic film 39 is installed to bridge the intervening space and provide a dust and smoke barrier.

Figure 5:
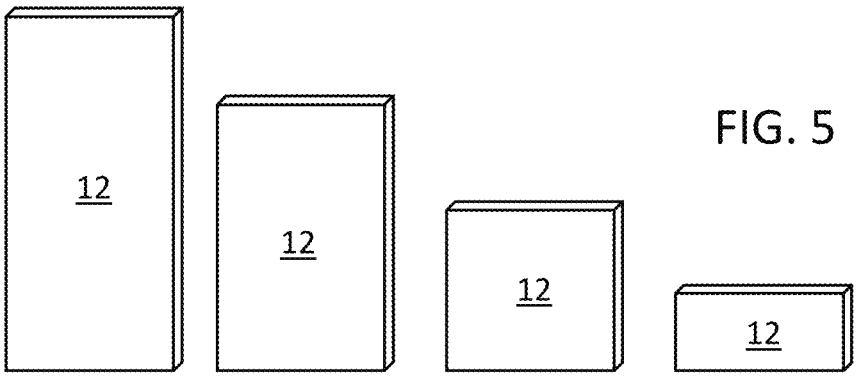
FIG. 5 shows an example of panel sizes for the barrier.

FIG. 5 shows by way of example only a set of panels 12 with four different dimensional sizes (where the heights of the four panels 12 are different and the panels share a common width). As an alternative, it will be noted that different widths of the panels can also be considered, with each different width having an associated set of different heights. Any suitable side-by-side and/or stacked arrangement of plural panels may be made to accommodate building of barrier of needed size for partitioning the space.

With reference once again to FIGS. 1, 2 and 3, the panels 12 are interlocked with each other using an interlocking mechanism. In an embodiment, the interlocking mechanism comprises a tongue and groove assembly (not shown in FIGS. 1, 2 and 3, see FIGS. 7A1 and 7A2 for example) and a panel lock mechanism (not shown in FIGS. 1, 2 and 3, see FIGS. 8A-8C). This is just one example, and other interlocking mechanisms could instead be utilized.

The use of an interlocking panel-based assembly for the barrier 10 provides for maximum flexibility and adaptability to handle a wide range of installation conditions or situations as typically arise in order to meet the needs for containment of an interior space during renovation. This is accomplished through the provision of interlocking panels with varying dimensional sizes that can be specifically selected to meet the length and height requirements of the barrier for partitioning off the space.

The barrier 10 is designed to provide basic but complete functionality for a fire barrier system that meets, at the very least, ASTM E-84 and E-119 performance requirements. Additionally, the barrier 10 is designed to provide a smoke barrier and an Infection Control Risk Assessment (ICRA) negative pressure performance functionality.

Reference is now made to FIGS. 6A and 6B which show perspective views of an individual panel 12. The peripheral edge (top, bottom, left, right) of each panel is provided with a tongue and groove assembly, and left and right edges of each panel also support a panel lock mechanism (to be described, see FIGS. 8A-8C) for interlocking laterally adjacent panels to each other at a vertical joint to provide a greater width for the barrier, and wherein the tongue and groove assembly at the top/bottom edges supports vertically interconnecting panels at a horizontal joint to provide a taller height for the barrier. As an example, two adjacent side edges (top and right edges of a pair of adjacent edges in the illustration of FIG. 6A) are provided with tongues 50 and the opposite two adjacent side edges (left and bottom edges of another, opposed, pair of adjacent edges in the illustration of FIG. 6A) are provided with grooves 52. The tongue and groove assembly of the panels supports the provision of airtight joints as well as minimizes the seam between adjacent panels (see FIG. 7A1 showing the tongue and groove assembly with the panels disconnected, and FIG. 7A2 showing the tongue and groove assembly with the panels connected in the interlocked configuration). The panels are symmetrical in design with the side faces 54 being the same, and are configured to be clean/cleanable. The panels 12 provide fire rated protection and further provide for sound attenuation. In an alternative implementation, the tongue and groove assembly is provided only with respect to the left and right edges of the panels 12 (with those edge further including the lock mechanism).

Figure 7B:
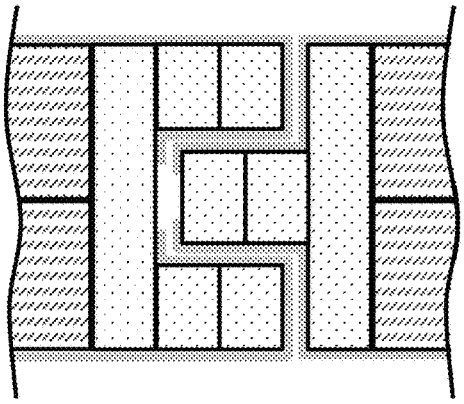
FIGS. 7B and 7C are cross sectional views of the panel.
Figure 7B:
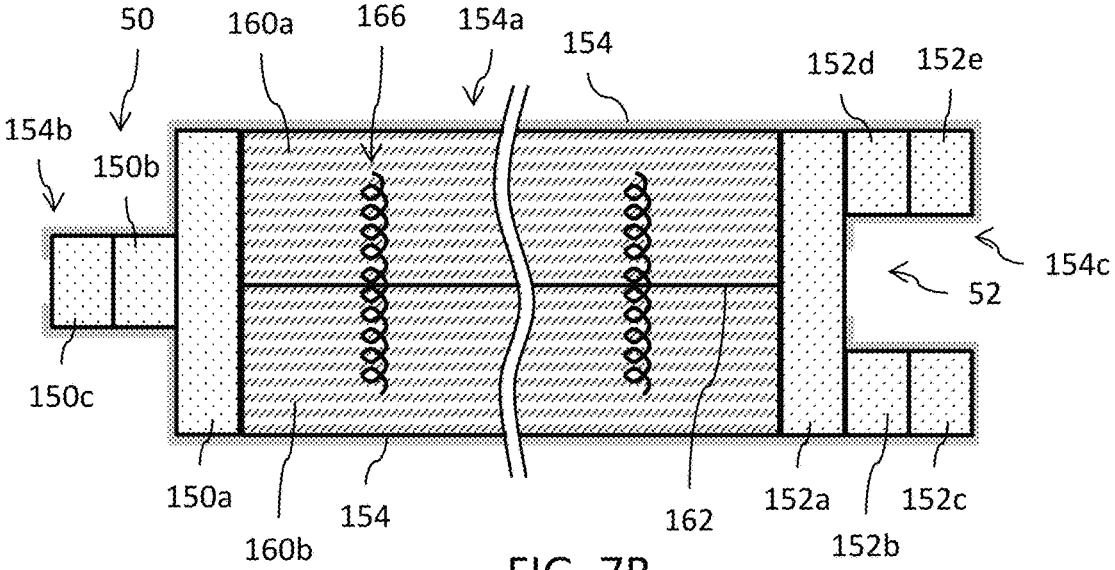
Figure 7C:
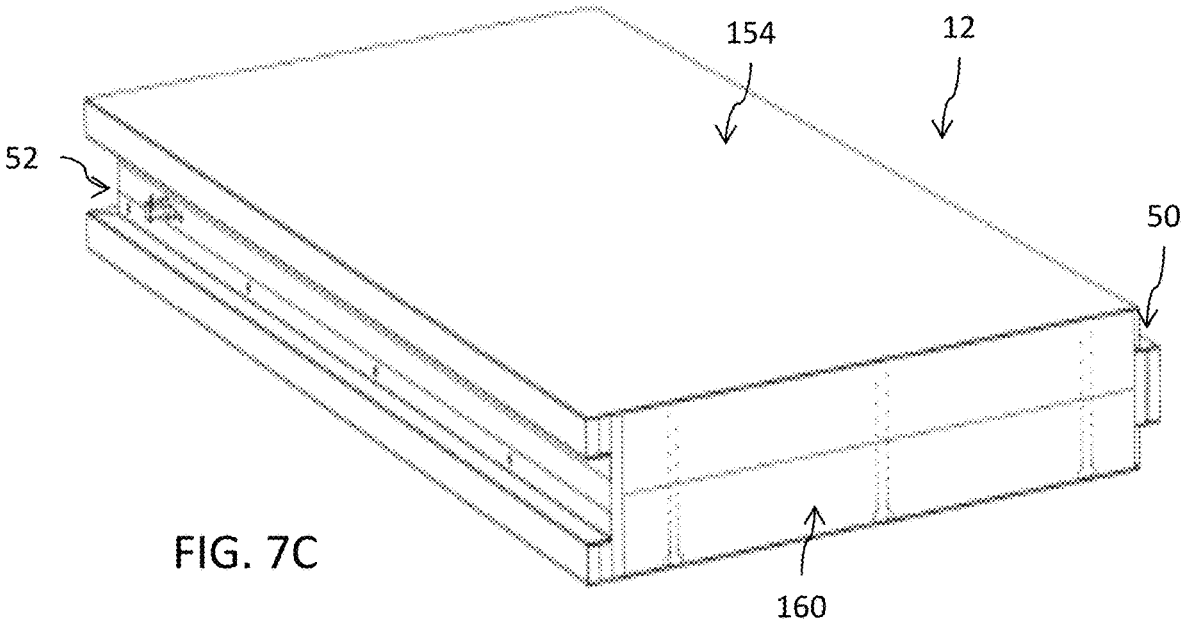

With additional reference now to FIG. 7B which shows a cross sectional illustration of a panel 12, as well as FIG. 7C which shows a cross-sectional perspective view of a panel, it will be noted that a peripheral frame is provided for each panel along the peripheral panel edge and that the peripheral frame defines the tongue 50 and groove 52. The peripheral frame is formed by a stack of strips made of magnesium oxide (MgO) that are assembled together. Each tongue 50 portion of the peripheral frame is made of a stack of three strips 150*a*, 150*b* and 150*c*, with strips 150*b* and 150*c* stacked, aligned and glued to each other and then stacked and glued to strip 150*a* in alignment with a longitudinal center of strip 150*a*. The strips 150 have a same thickness, with strip 150*a* having a width that is slightly less than a thickness of the panel and the strips 150*b* and 150*c* having widths selected in accordance with a size of the groove 52. This assembly of strips 150*a*, 150*b* and 150*c*, in cross section, forms a T-shape for each tongue 50 portion of the peripheral frame (where the top portion of the T-shape provides a support member and the lower portion of the T-shape provides the tongue member extending from the support member). Each groove 52 portion of the peripheral frame is made of a stack of five strips 152*a*, 152*b*, 152*c*,

152*d* and 152*e*, with strips 152*b* and 152*c* stacked, aligned and glued to each other and then stacked and glued to strip 152*a* in a position such that edges thereof are flush with one outer edge of strip 152*a* and with strips 152*d* and 152*e* stacked, aligned and glued to each other and then stacked and glued to strip 152*a* in a position such that edges thereof are flush with an opposite outer edge of strip 152*a*. The strips 152 have a same thickness, with strip 152*a* having a width that is slightly less than a thickness of the panel and the strips 152*b*, 152*c*, 152*d* and 152*e* having widths selected in accordance with a size of the tongue 50. This assembly of strips 152*a*, 152*b*, 152*c*, 152*d* and 152*e*, in cross section, forms a U-shape (where the lower portion of the U-shape provides a support member and the upper portions of the U-shape provide the groove side wall members extending from the support member).

The reference above to a particular number of strips of MgO being used in assembling the frame is by example only, it being understood that the frame can be made of any suitable number of strips (more or less that that described above).

For example, in connection with an alternative implementation, the tongue portions 50 and groove portions 52 of the peripheral frame of the panel 12 may instead each be made of a single piece of MgO material that is dimensioned and milled to form the T-shape and U-shape cross sectional profiles, respectively, that are needed for the tongue and groove assembly.

The use of Magnesium Oxide for the material of the peripheral frame is preferred as the MgO material releases water molecules when heated, with the water being converted to steam in a fire event. This serves to regulate heat flow (thermal transfer) through the panel.

The opposed side faces 54 of each panel 12 are formed by a metal layer 154 (for example, made of steel sheet material) that is secured (for example, using mounting screws and/or adhesive) to the dimensional strips 150, 152 forming the peripheral frame. The metal layer 154 on one side of the panel 12 is not directly connected to the metal layer 154 on the opposite side of the panel 12 in order to ensure there is no direct thermal channel between the opposed faces 54 of the panel. Each metal layer 154 may be formed of multiple pieces or portions including a face portion 154*a*, a tongue portion 154*b* and a groove portion 154*c*. The face portion 154*a* covers the side face 54 as well as the end surface of strip 150*a* at the tongue 50 and the end surface of strip 152*c* (152*e*) at the groove 52. The tongue portion 154*b* covers at least a portion of the end of the strip 150*c* and the sides of the strips 152*b*, 152*c* at the tongue 50. The groove portion 154*c* covers at least a portion of the strip 152*a* and inner sides of the strips 152*b*, 152*c* (inner sides of the strips 152*d*, 152*e*) at the groove 52. The portions 154*a*, 154*b*, 154*c* may be provided as separate pieces that are assembled together to form the metal layer 154 for each of the opposed side faces 54.

The interior space of the panel 12 delimited by the peripheral frame and the opposed face portions 154*a* is filled with a thermal insulator which includes, for example, a stack of two mineral wool layers 160*a*, 160*b*. A layer 162 of aluminum foil may be positioned between the two mineral wool layers 160*a*, 160*b* to form a radiant thermal barrier layer for the thermal insulator. Coil anchors 166 made of a coil wound metal wire material may be used to join the two mineral wool layers 160*a*, 160*b* to each other, with each coil anchor extending through the aluminum foil layer 162 (if present) and engaging the material of layers 160*a* and 160*b*. A plurality of these coil anchors 166 are provided for each panel 12, and the plurality of coil anchors 166 are positioned in an array (or matrix) format (for example, at the locations identified by "+" indicators in FIG. 6B). In an embodiment, an adhesive layer may be used to attach the mineral wool layers 160*a*, 160*b* to each other and further adhesive layers may be used to attach the mineral wool layers 160*a*, 160*b* to their adjacent face portions 154*a*.

An alternative embodiment for the tongue configuration of the panels is shown in FIG. 7A3. Like references in FIGS. 7A1, 7A2 and 7A3 refer to like or similar components. The tongue configuration of FIG. 7A3 differs from FIGS. 7A1 and 7A2 in that strip 150*a* has been omitted, with the face portion 154*a* of metal layer 154 providing the lateral support between opposed faces of the panel.

Figure 8A:
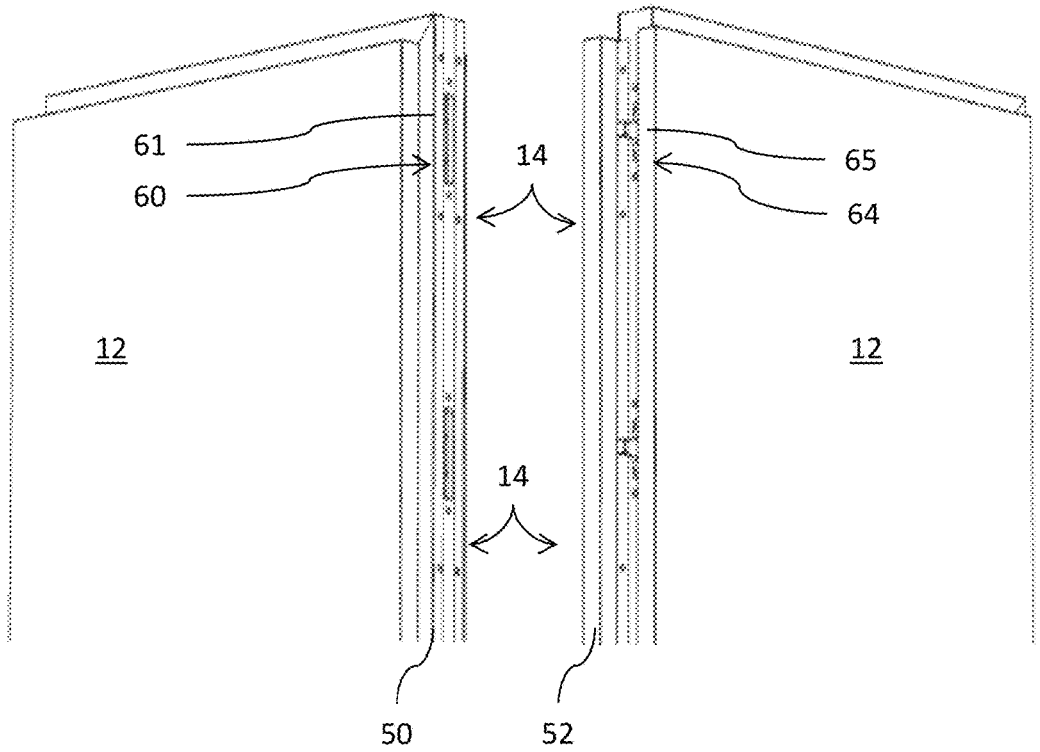
FIGS. 8A, 8B and 8C illustrate views of a panel lock mechanism for joining adjacent panels in the barrier.

Adjacent panels 12 are locked to each other using a panel lock mechanism 14 provided in the form of mounted hardware as shown in FIGS. 8A-88C. The panel lock mechanism 14 includes a strike plate 60 mounted within an opening 61 in the tongue 50. The opening 61 may, for example, be formed in the strips 150*b*, 150*c* of the tongue portion. The strike plate 60 includes a slot opening 62. The slot opening 62 has, in plan view, a dog-bone type shape with larger holes 62*a* at opposite ends joined by a narrower channel 62*b*. The panel lock mechanism 14 further includes a latch plate 64 mounted within an opening 65 in the groove 52. The opening 65 may, for example, by formed in the strip 152*a* of the groove portion. The latch plate 64 includes a latch knob 66 extending perpendicularly from the plate. The general shape of the latch knob 66 includes a shaft portion 66*a* mounted at a proximal end to the latch plate 64, and a head portion 66*b* mounted at a distal end of the shaft portion 66*a*. The diameter of the shaft portion 66*a* is smaller than the width of the channel 62*b*. The diameter of the head portion 66*b* is smaller than the hole 62*a* but larger than the width of the channel 62*b*.

To interlock one panel to another panel, a lift and drop construction is supported where the tongue 50 of one panel is inserted into the groove 52 of another panel with the head portion 66*b* aligned with and inserted into the hole 62*a*. The one panel is then dropped into place with the head portion 66*b* engaging the channel 62*b* to secure the two panels together. The tongue and groove engagement of the panels 12 along with the panel lock mechanism 14 produces a tight interlock between panels that supports ICRA Class IV performance of the barrier 10.

Figure 9:
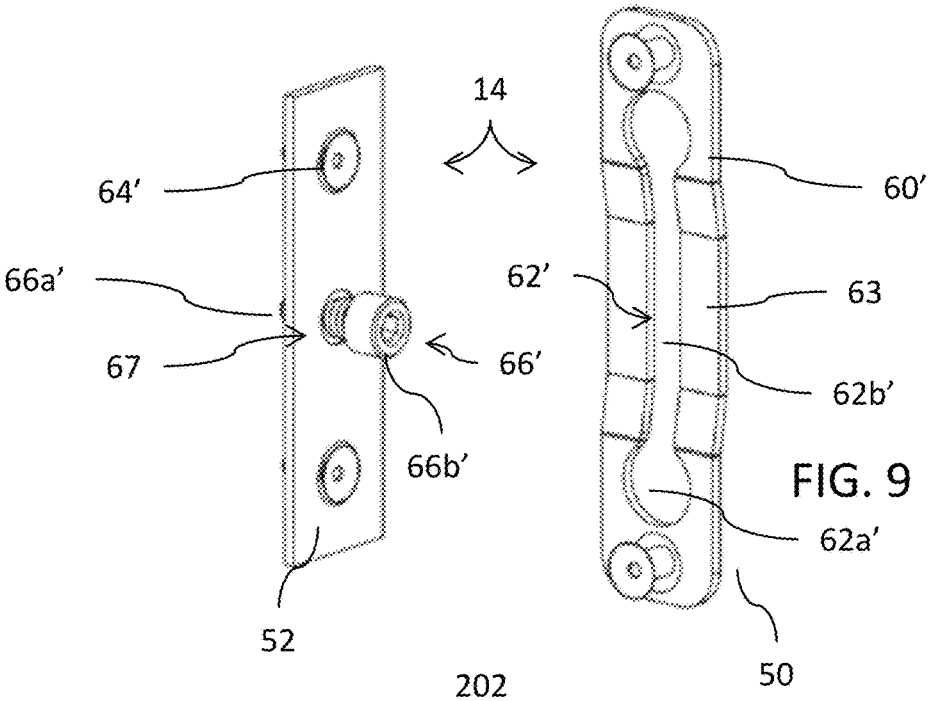
FIG. 9 shows an alternative embodiment for the panel lock mechanism.

Reference is now made to FIG. 9 which shows an alternative embodiment for the panel lock mechanism 14. The panel lock mechanism 14 includes a strike plate 60' mounted at the tongue 50. The strike plate 60' includes a slot opening 62'. The slot opening 62' has, in plan view, a dog-bone type shape with larger holes 62*a*' at opposite ends joined by a narrower channel 62*b*'. The strike plate 60' is not flat, and includes a mounting portion in one plane and a recessed portion in another (offset) plane. This configuration is accomplished by including bends in the strike plate 60' adjacent each of the holes 62*a*' which cause the plate to include an offset (or recessed) portion 63 along the length of the channel 62*b*'. The panel lock mechanism 14 further includes a latch plate 64' mounted at the groove 52. The latch plate 64' includes a latch knob 66' extending perpendicularly from the plate. The general shape of the latch knob 66' includes a threaded shaft portion 66*a*' that engages a threaded opening 67 in the latch plate 64', and a head portion 66*b*' mounted at a distal end of the shaft portion 66*a*'. The diameter of the shaft portion 66*a*' is smaller than the width of the channel 62*b*'. The diameter of the head portion 66*b*' is smaller than the hole 62*a*' but larger than the width of the channel 62*b*'.

To interlock one panel to another panel, a lift and drop construction is supported where the tongue 50 of one panel is inserted into the groove 52 of another panel with the head portion 66*b*' aligned with and inserted into the hole 62*a*'. The one panel is then dropped into place with the head portion 66*b*' engaging the channel 62*b*' at the offset (or recessed) portion 63 at the back of the plate 60' to draw the panels into tight interlock. The tongue and groove engagement of the panels 12 along with the panel lock mechanism 14 produces a tight interlock between panels that supports ICRA Class IV performance of the barrier 10. It will be noted that the use of the threaded shaft portion 66*a*' permits an adjustment to be made in the distance positioning (i.e., extension) of the head portion 66*b*' in order to ensure proper engagement with the offset (or recessed) portion 63.

Figure 8B:
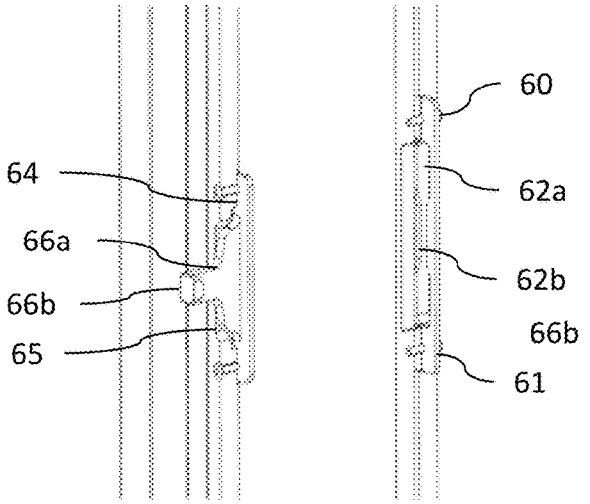
Figure 8C:
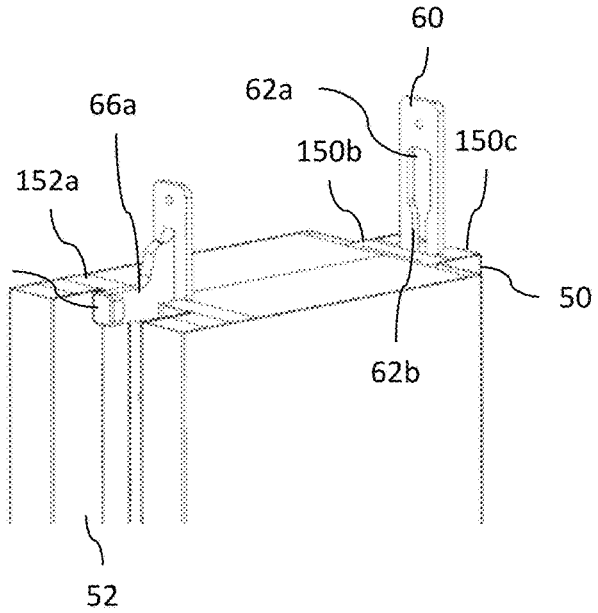

It will be noted that the latch plate 64 with head portion 66*b* (FIG. 8B) may be used in conjunction with the strike plate 60' and slot opening 62' (FIG. 9). Alternatively, latch plate 64' with head portion 66*b*' (FIG. 9) may be used in conjunction with the strike plate 60 and slot opening 62 (FIG. 8B).

Figure 10:
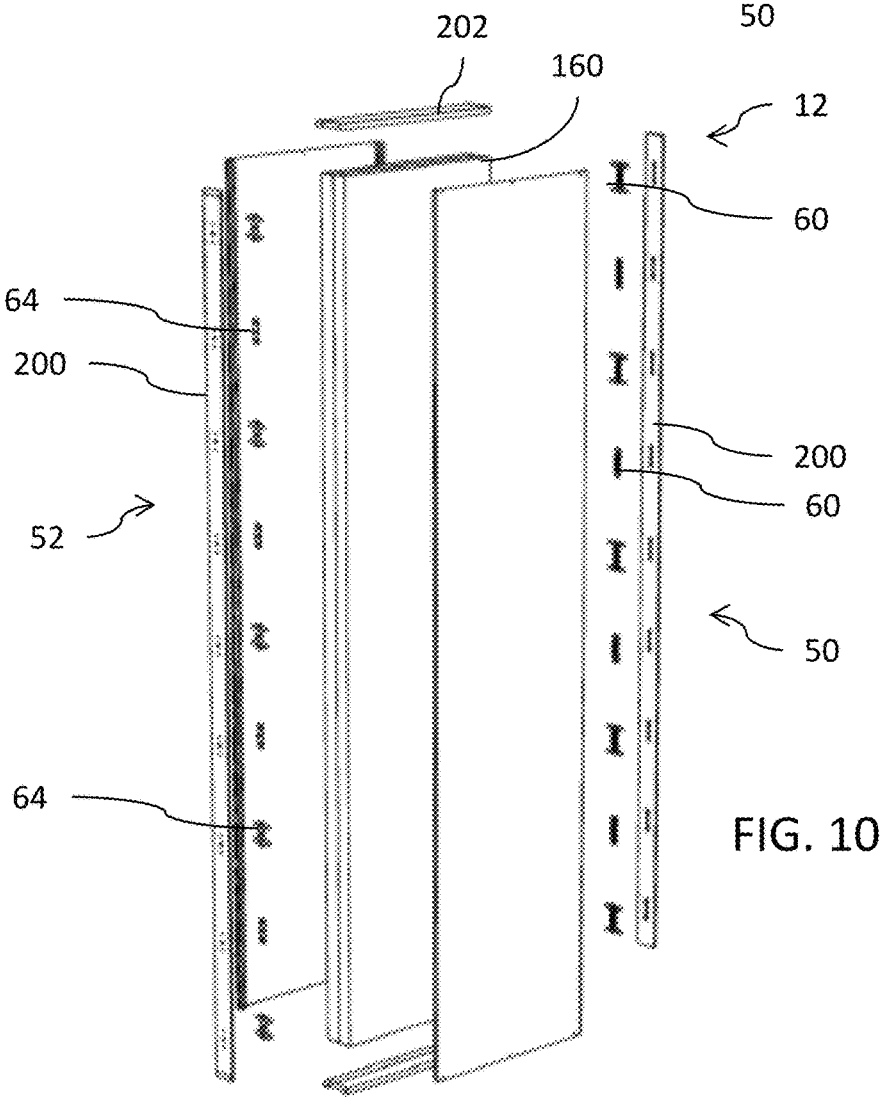
FIG. 10 illustrates an exploded perspective view of an embodiment for a panel.

Reference is now made to FIG. 10 which shows an exploded perspective view of an embodiment for the panel 12. The peripheral frame is formed by vertical members 200 (for the left and right side edges) and horizontal members 202 (for the top and bottom side edges). Each member 200, 202 is made, for example, of a MgO material. The vertical members 200 are formed to define the tongue 50 and the groove 52. In this implementation, the horizontal members 202 are not shown to be formed for defining a tongue and a groove, but it will be understood that such a configuration (like that shown in FIG. 1) is possible. The vertical member 200 for the tongue 50 includes a plurality of openings within each of which a strike plate 60 is installed. The vertical member 200 for the groove 52 includes a plurality of openings within each of which a latch plate 64 is installed. The opposed side faces of each panel 12 are formed by a metal layer 154 that is secured (for example, using mounting screws) to the members 200, 202 forming the peripheral frame. The interior space of the panel 12 delimited by the peripheral frame and the opposed face portions 154*a* is filled with one or more layers 160 of mineral wool (and radiant barrier layer 162 and coil anchors 166, where desired, as shown in FIG. 7B).

Figure 11A:
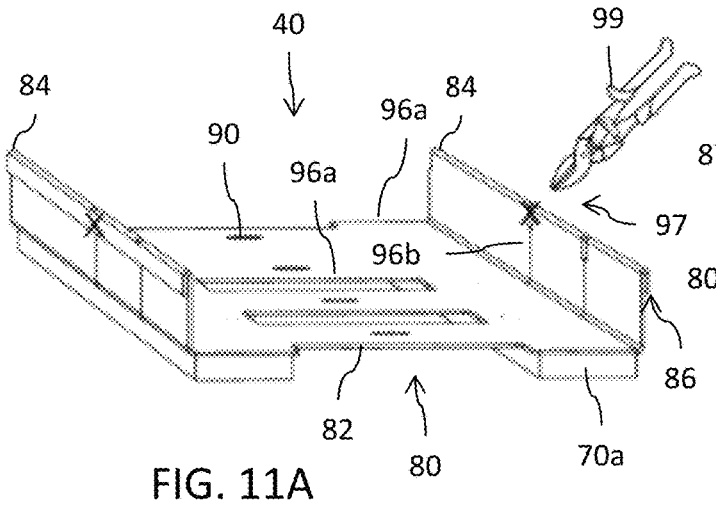
FIGS. 11A and 11B illustrate an embodiment for a floor track module.
Figure 11B:
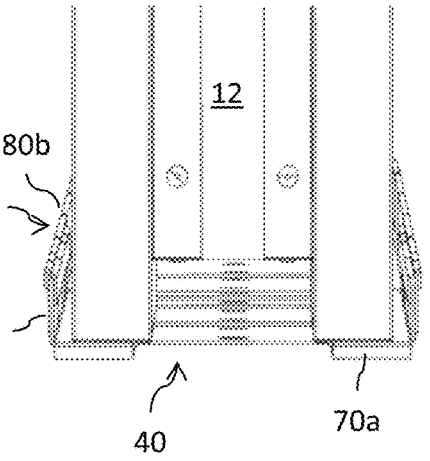

With reference once again to FIG. 1, the panels 12 rest on a floor track module 40 which provides a stable mounting element for the panels. Details of an embodiment for the floor track module 40 are provided in FIGS. 11A and 11B. FIG. 11A shows a perspective view of the module 40 itself, while FIG. 11B shows a view with a panel 12 installed in the module 40. The floor track module 40 includes a metal bracket 80 having a base member 84 and opposed side walls 82 which extend from opposite longitudinal sides of the base member 84 and thus form a channel for receiving a bottom edge of the panels. An upper edge of each side wall 82 includes a fold over 86 to add structural rigidity. A rubber gasket 70*a* is provided at the bottom surface of the base member 84 to engage and seal against the floor. The rubber gasket 70*a* not only provides a sealing function but also inhibits sliding or lateral movement of the panels after installation (this being especially beneficial in cases where the floor track module 40 cannot be fixed to the floor). A rubber gasket may also be is provided at the upper surface of the base member 84 to engage and seal against the panel 12. It will be noted that this gasket is optional.

The base member 84 includes a plurality of through holes 90 arranged along the longitudinal center line. These through holes 90 are configured to receive mounting hardware (such as bolts or screws) for securing the floor track module 40 to the floor. It will be noted that securing the floor track module 40 to the floor is optional.

The base member 84 further includes a plurality of cut lines 96*a* that extend laterally across the base member 84 between the two side walls 82. The pitch of (i.e., distance between) the cut lines 96*a* may, for example, be every 6 inches or 12 inches.

The base member 84 still further includes a plurality of perforation lines 96*b* that extend laterally across the side walls 82 from the base member 84 to the fold over 86. The The pitch of (i.e., distance between) the perforation lines 96*b* may, for example, be every 6 inches or 12 inches. Each perforation line 96*b* is formed by a plurality of small through holes arranged in a line. The cut lines 96*a* and perforation lines 96*b* are longitudinally aligned with each other. The cut lines 96*a* and perforation lines 96*b* weaken the rigidity of the base member 84 and side wall 82, respectively, but the overall rigidity of the metal bracket 80 is not unacceptably compromised (given the existence of portions of the base member 84 and the included fold overs 86). The cut lines 96*a* and perforation lines 96*b* serve an important function in allowing for a customization of the length of the floor track module 40. An installer can use metal snips 99 to cut through the fold overs 86 and the side walls 82 at the perforation lines 96*b* (see, generally, the location "X" and reference 97) and then bend the base member 84 back and forth at the location of the cut line 96*a* until it breaks, with the length of the floor track module 40 being set by the distance from an end to that cut line 96*a*.

Figure 12:
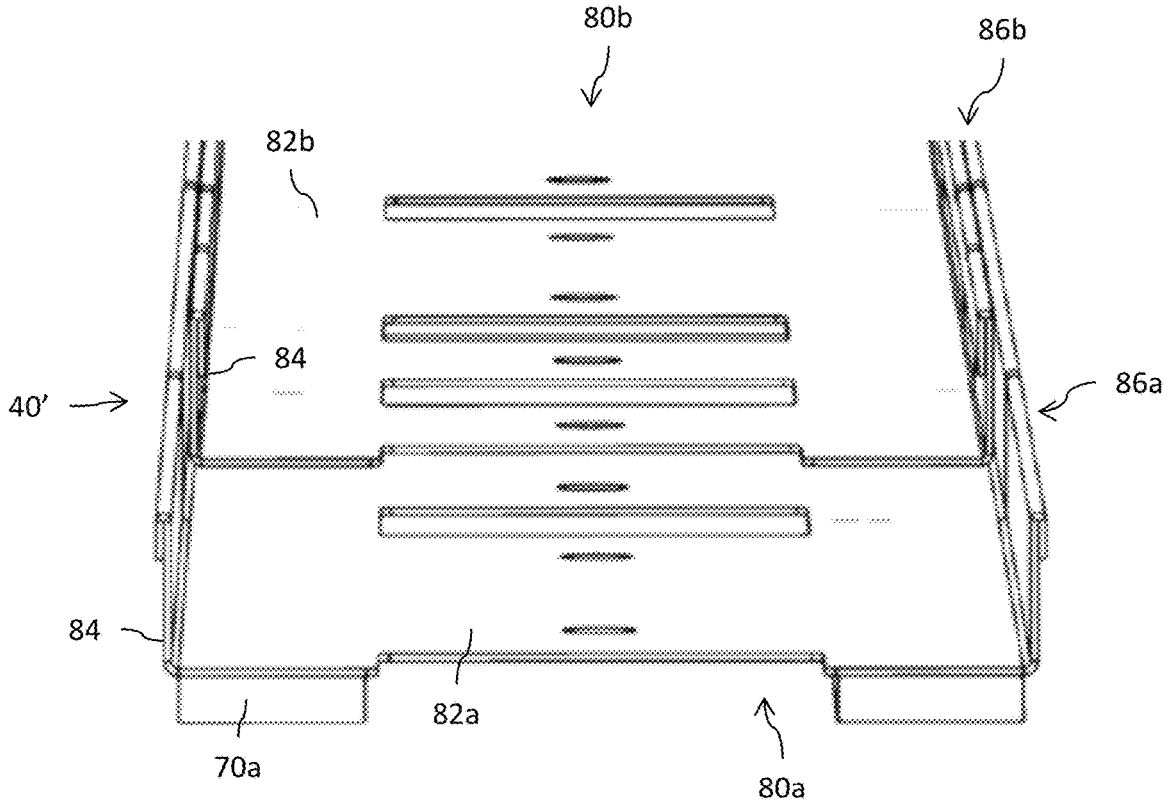
FIG. 12 shows a telescoping embodiment for the floor track module.

FIG. 12 shows an alternative embodiment for the floor track module 40'. The floor track module 40' includes a first metal bracket 80*a* and a second metal bracket 80*b* which are configured in a telescoping arrangement where the second metal bracket 80*b* may longitudinally slide in and relative to the first metal bracket 80*a*. Each metal bracket 80*a*, 80*b* includes a base member 84 and opposed side walls 82 which extend from opposite longitudinal sides of the base member 84. The base member 84 of the second metal bracket 80*b* is laterally sized, however, to fit within (i.e., between) the opposed side walls 82 of the first metal bracket 80*a*. An upper edge of the side walls 82 for the first metal bracket 80*a* includes a fold over 86*a* to add structural rigidity. Similarly, an upper edge of the side walls 82 for the second metal bracket 80*b* includes a fold over 86*b* to add structural rigidity.

In the embodiment shown in FIG. 12, the fold over 86*b* is configured with a gap (or space) between the folded over part and the side wall 82 that is large enough so that the fold over 86*a* of the first metal bracket 80*a* can fit therein in support of the telescoping arrangement. In an alternative arrangement, the fold over 86*b* is configured to fold inside, while the fold over 86 is configured to fold outside in support of the telescoping arrangement. This alternative configuration can be generally seen at reference 87 in FIG. 11B where the two distinct fold over directions are shown for the brackets 80*a* and 80*b* arranged in a telescoping manner to support panel 12.

The base member 84 for the second metal bracket 80*b* may include at least one (and perhaps a plurality of) cut line 96*a* and each side wall 82 for the second metal bracket 80*b* may include at least one (and perhaps a plurality of) perforation line 96*b* aligned with the cut line 96*a*. The cut line 96*a* and aligned perforation lines 96*b* are not explicitly shown in FIG. 12, but would have the configuration as shown in detail in FIG. 11A. Like with the implementation of FIG. 11A, the cut line 96*a* and aligned perforation lines 96*b* support installer customization of the length of the bracket 80*b*. It will be understood, however, the both the first metal bracket 80*a* and the second metal bracket 80*b* could be configured to include cut lines 96*a* and perforation lines 96*b*.

Figure 13A:
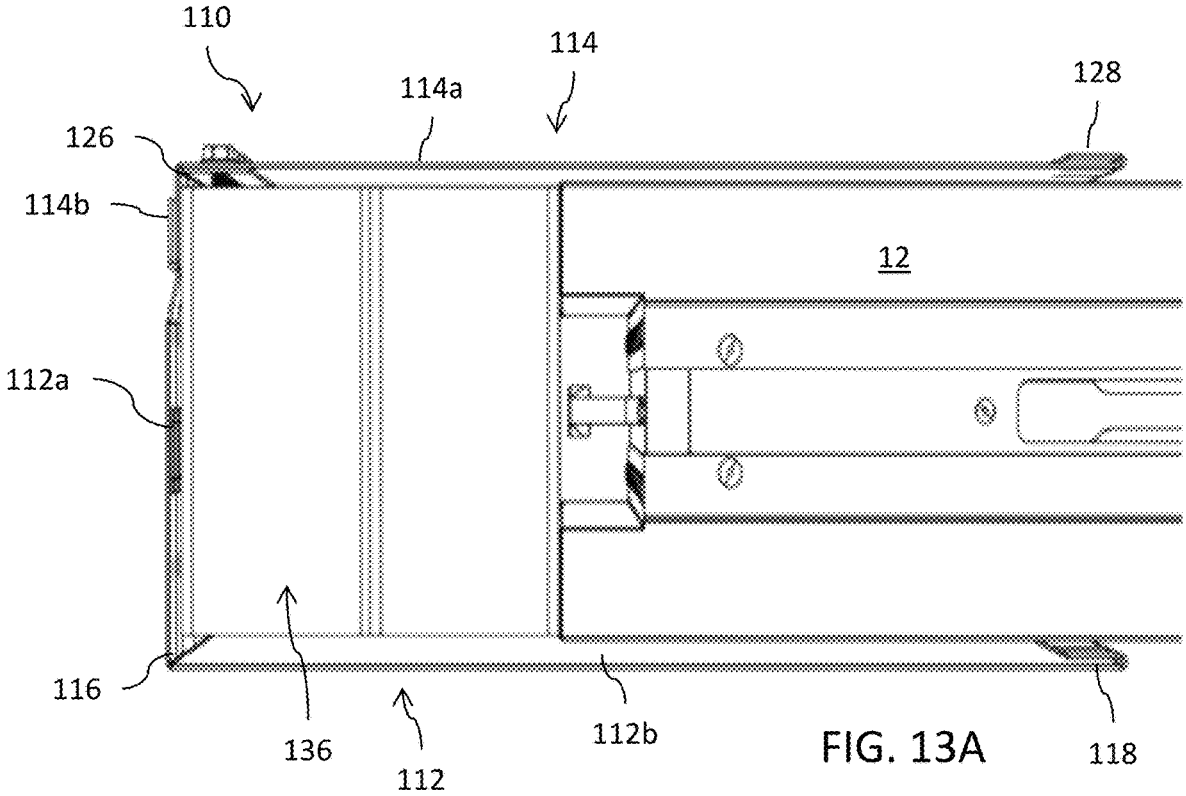
FIGS. 13A-13B illustrate an embodiment for a wall/soffit interface module.
Figure 13B:
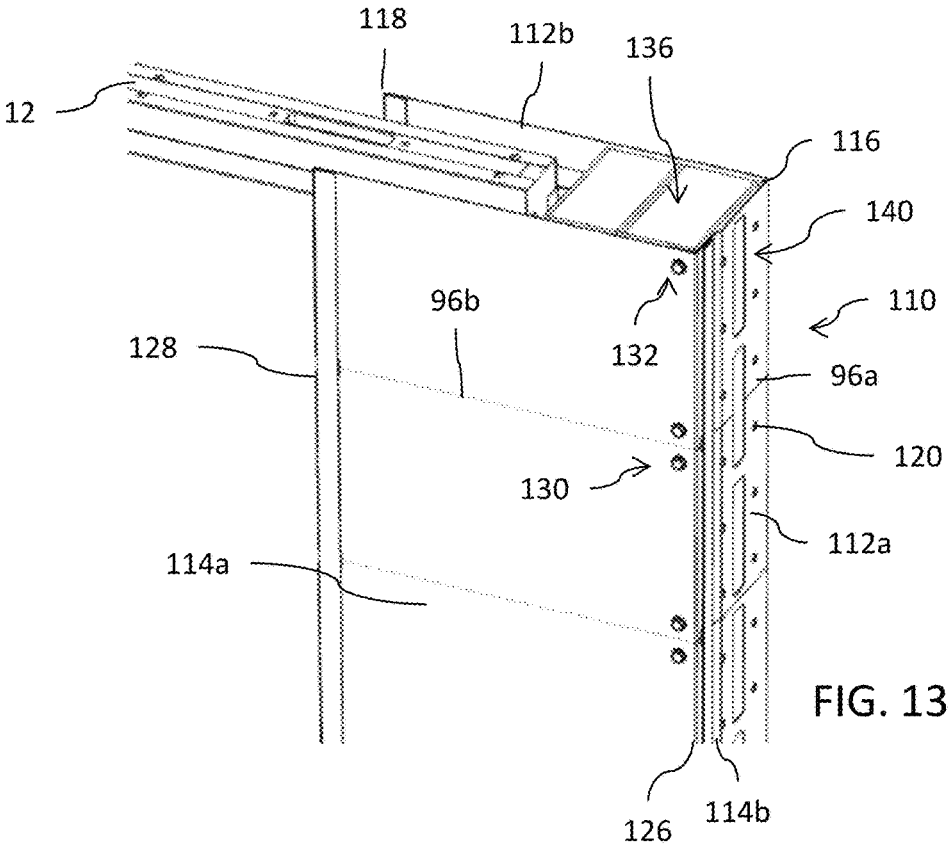
Figure 13C:
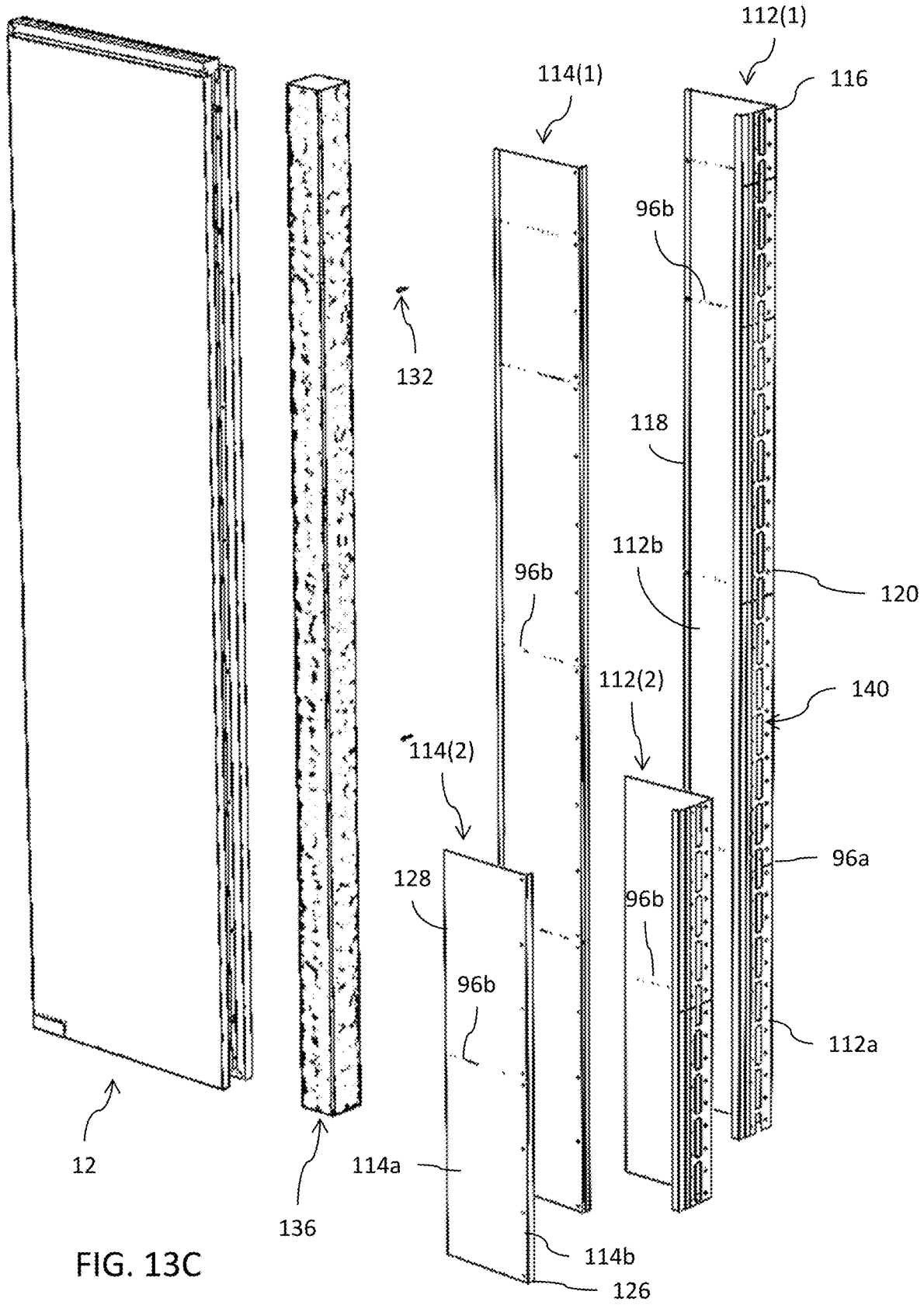
FIG. 13C is an exploded perspective view of the wall/soffit interface module as shown in FIGS. 13A-13B.

The attachment of the barrier 10 to either the existing wall 36 of the space or to the soffit 32 of the space is made through an interface module 110 as shown in FIGS. 13A, 13B and 13C. The interface module 110 includes a base section 112 and a cover section 114 that are mounted to each other to define a channel for receiving a panel 12. The base section 112 has an L-shaped cross section and is formed by a bottom member 112*a* and wall member 112*b* that join at a corner 116. A distal edge of the wall member 112*b* includes a fold over 118 to add structural rigidity. The bottom member 112*a* includes a plurality of through holes 120 arranged along the longitudinal center line. These through holes 120 are configured to receive mounting hardware (such as bolts or screws) for securing the interface module 110 to the wall 36 or soffit 32. It will be noted that an angle between the bottom member 112*a* and wall member 112*b* at corner 116 is preferably less than ninety-degrees in order to bias the wall member 112*b* towards the outer face of the panel 12. The cover section 114 also has an L-shaped cross section and is formed by a face member 114*a* and flange member 114*b* that join at a corner 126. A distal edge of the face member 114*a* includes a fold over 128 to add structural rigidity. It will be noted that an angle between the face member 114*a* and flange member 114*b* at corner 126 is preferably less than ninety-degrees in order to bias the face member 114*ab* towards the outer face of the panel 12.

To support coupling of the cover section 114 to the base section 112, the cover section 114 includes a plurality of through holes 130 periodically arranged adjacent the corner 126. Mounting hardware, such as self tapping screws 132, can be inserted through the holes 130 of the cover section 114 to engage the base section 112 (see, details below).

A mineral wool filler 136 is provided in the space between the end of the panel 12 and the bottom member 112*a* of the interface module 110. As an alternative, a sealed package formed from a blend of mineral wool filler and intumescent material can be inserted in the space between the end of the panel 12 and the bottom member 112*a* of the interface module 110. An advantage of the package implementation is that in a fire event the intumescent material will expand to better fill the void.

Figure 14A:
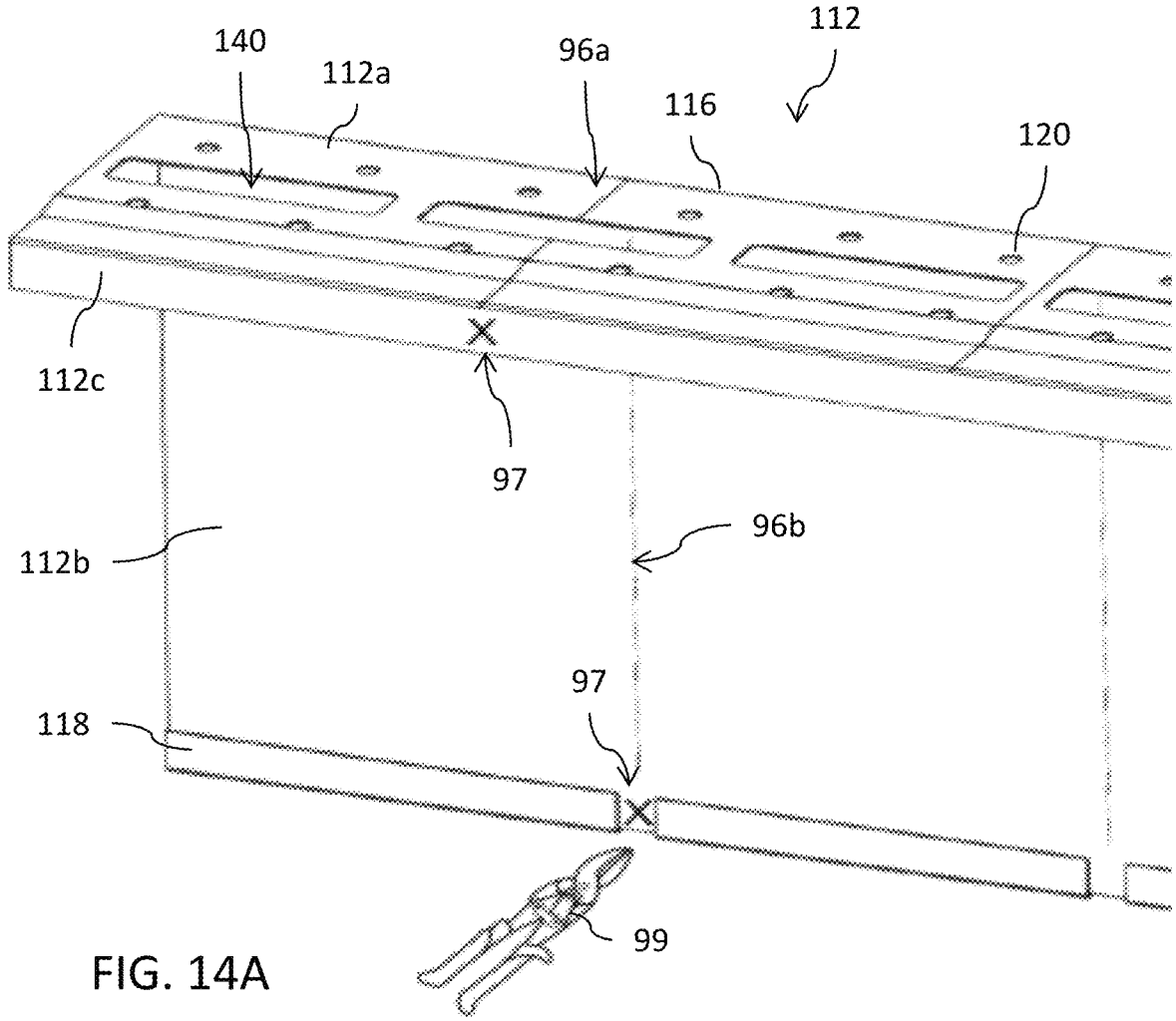
FIGS. 14A-14B illustrate a telescoping embodiment for the wall/soffit interface module.

A detailed view of the base section 112 of the interface module 110 is shown in FIG. 14A. The base section 112 may further include a flange 112*c* at the distal edge of the bottom member 112*a*. This flange 112*c* not only adds structural rigidity, but it also provides a mounting surface to be used in connection with securing the cover section 114 to the base section 112 using screws 132 passing through the holes 130 of the face member 114*a* which can then engage the flange 112*c* (see, FIGS. 13B and 14B).

The wall member 112*b* includes a plurality of perforation lines 96*b* that extend laterally across the wall member 112*b* from the fold over 118 to the corner 116. The pitch of (i.e., distance between) the perforation lines 96*b* may, for example, be every 6 inches or 12 inches. Each perforation line 96*b* is formed by a plurality of small through holes arranged in a line. The perforation line 96*b* weakens the rigidity of the wall member 112*b*, but the overall rigidity of the base section 112 is not unacceptably compromised (given the existence of the corner 116 and the included fold over 118).

The bottom member 112*a* further includes a plurality of cut lines 96*a* that extend laterally across the bottom member 112*a* from the fold over 118 to the flange 112*c*. The pitch of (i.e., distance between) the cut lines 96*a* may, for example, be every 6 inches or 12 inches, and these cut lines are aligned with the perforation lines 96*b*. Each cut line 96*a* is formed by a single sever line. The cut line 96*a* weakens the rigidity of the bottom member 112*a*, but the overall rigidity of the base section 112 is not unacceptably compromised (given the existence of the corner 116 and the included flange 112*c*).

Each aligned cut line 96*a* and perforation line 96*b* and serves an important function in allowing for a customization of the length of the base section 112 of the interface module 110. An installer can use metal snips 99 to cut through the flange 112*c* and fold over 118 at the location "X" of the perforation line 96*b* and cut line 96*a* (references 97) and then bend the structure of the base section 112 back and forth until it breaks, with the length of the base section 112 of the interface module 110 being set by the distance from an end to that severed perforation line 96*b* and cut line 96*a*.

In addition to the plurality of through holes 120 for mounting, the bottom member 112*a* further includes a plurality of cooling slots 140 arranged along the length of the base section 112 of the interface module 110. These cooling slots 140 serve to reduce the thermal transfer (conduction) laterally through the interface module 110.

Figure 14B:
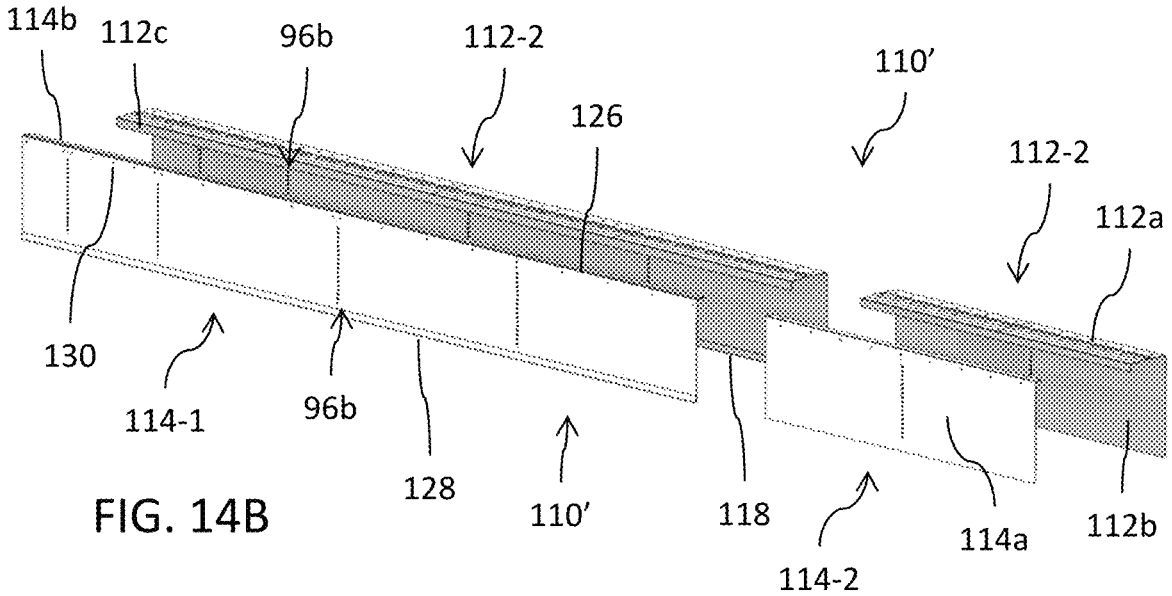

FIG. 14B shows an alternative embodiment for the interface module 110'. The interface module 110' includes a first base section 112-1 and a second base section 112-2 which are configured in a telescoping arrangement where the second base section 112-2 may longitudinally slide in and relative to the first base section 112-1. Each base section 112-1, 112-2 includes a bottom member 112*a*, a wall member 112*b* and a flange 112*c*. The wall member 112*b* of the first base section 112-1 includes a fold over 118 (see, FIGS. 13A-13B), but the wall member 112*b* of the second base section 112-2 does not. The fold over 118 is configured with a gap (or space) between the folded over part and the wall member 112*b* that is large enough so that the wall member 112*b* of the second base section 112-2 can fit therein in support of the telescoping arrangement. It will further be noted that the lateral width of the bottom member 112*a* for the second base section 112-2 is sized to fit between the flange 112*c* and wall member 112*b* of the first base section 112-1 in support of the telescoping arrangement.

The interface module 110' includes a first cover section 114-1 and a second cover section 114-2 which are configured in a telescoping arrangement where the second cover section 114-2 may longitudinally slide in and relative to the first cover section 114-1. Each cover section 114-1, 114-2 includes a face member 114*a* and a flange member 114*b*. The face member 114*a* of the first cover section 114-1 includes a fold over 128 (see, FIGS. 13A-13B), but the face member 114*a* of the second cover section 114-1 does not. The fold over 128 is configured with a space between the folded over part and the face member 114*a* that is large enough so that the face member 114*a* of the second cover section 114-2 can fit therein in support of the telescoping arrangement.

Each of the first cover section 114-1 and second cover section 114-2 include plurality of perforation lines 96*b* that extend laterally across the face member 114*a* from the fold over 128 to the corner 126. The pitch of (i.e., distance between) the perforation lines 96*b* may, for example, be every 6 inches or 12 inches. Each perforation line 96*b* is formed by a plurality of small through holes arranged in a line. The perforation line 96*b* weakens the rigidity of the face member 114*a*, but the overall rigidity of the cover sections 114-1, 114-2 is not unacceptably compromised (given the existence of the corner 126 and the included fold over 128).

Each perforation line 96*b* serves an important function in allowing for a customization of the length of the cover section 112 of the interface module 110. An installer can use metal snips 99 to cut through the flange member 114*b* and fold over 128 and then bend the structure of the cover section 114 back and forth until it breaks, with the length of the cover section 114 of the interface module 110 being set by the distance from an end to that severed perforation line 96*b*.

Figure 15A:
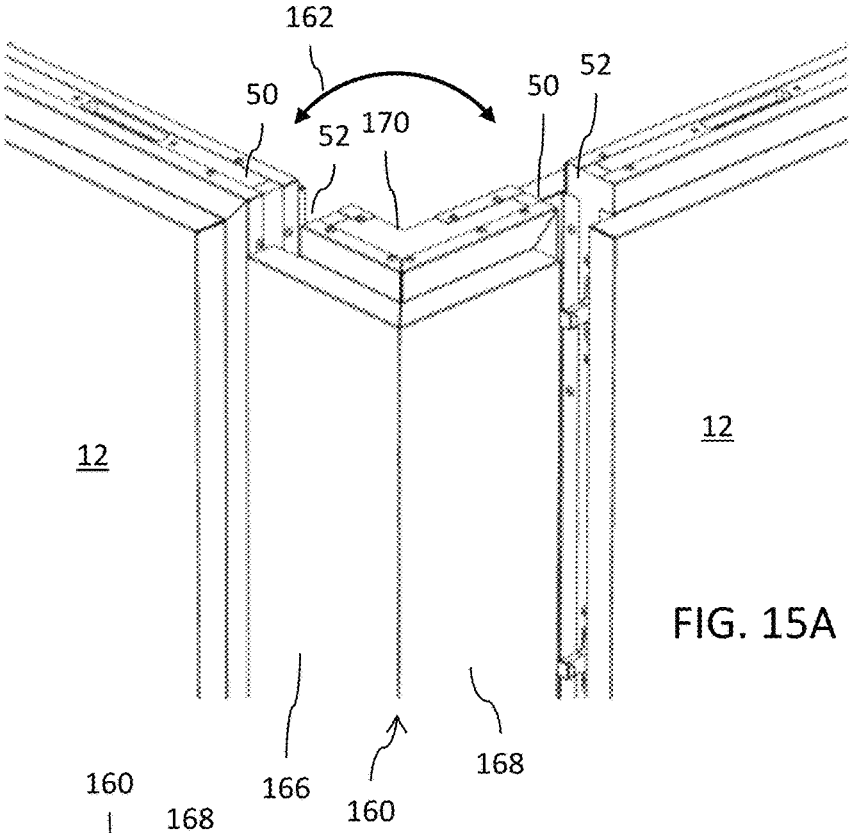
FIGS. 15A-15B are perspective views of a corner connector for supporting panels of the barrier.
Figure 15B:
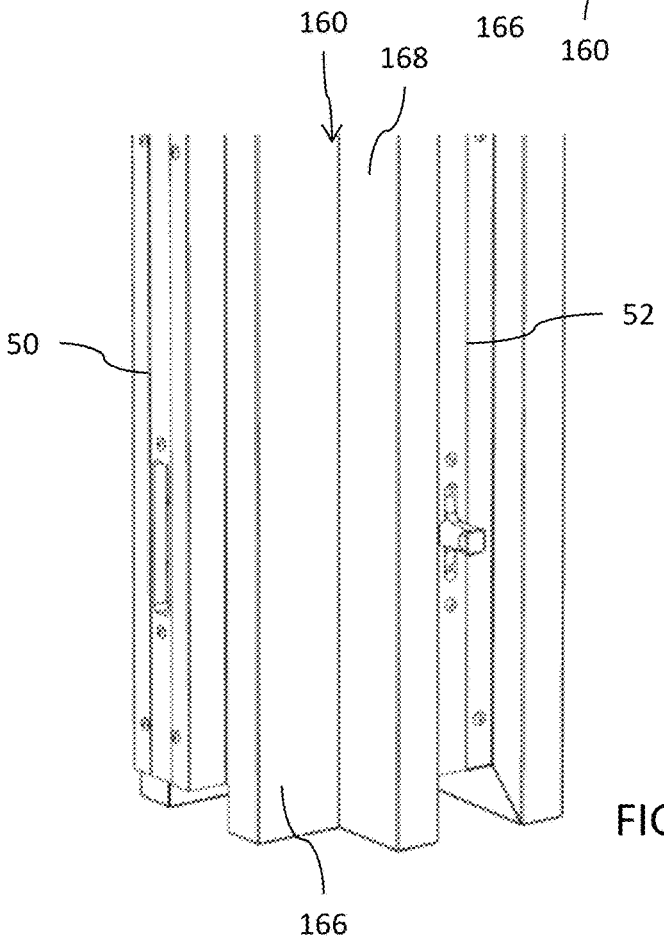

To accommodate change in direction of the barrier when partitioning a space, the barrier 10 further includes a corner connector 160 as shown in FIGS. 15A-15B. The angle 162 defined by the corner connector 160 is shown in the illustration as 90°, but it will be understood that the corner connector 160 can be made with any fixed selected angle (for example, 45° and 135°). The corner connector 160 is formed by a first leg portion 166 and second leg portion 168 which are coupled to each other through an angle transition portion 170 whose configuration defines the angle 162. The corner connector 160 is constructed in a same way as the panels 12 and supports interconnection with the same tongue and groove configuration (see, FIGS. 7A1, 7A2, 7Bb and 7C) and same panel lock (see, FIGS. 8A, 8B and 8C). For example, the first leg portion 166 includes the groove 52 and the second leg portion 168 includes the tongue 50. The corner connector 160 will be made of varying heights conforming to the heights of the panels (see, for example, FIG. 5).

Figure 16A:
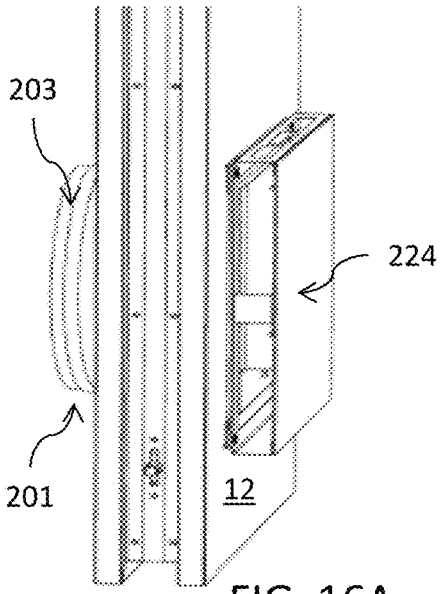
FIGS. 16A-16B are perspective views of specialized performance panels for the barrier.
Figure 16B:
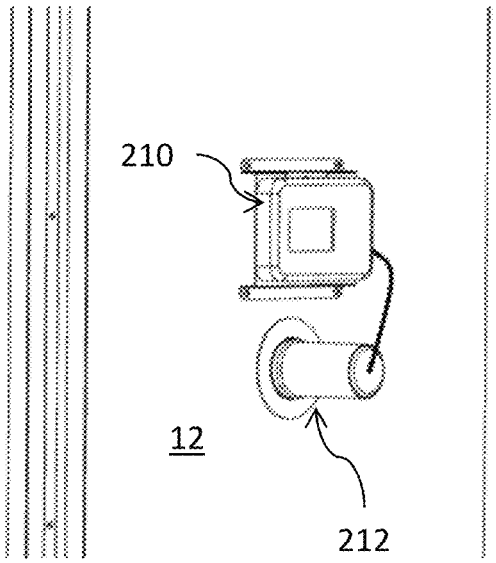

The barrier 10 may further be constructed to include specialized performance panels as shown in FIGS. 16A and 16B. More specifically, FIG. 16A shows a specialized performance panel which includes an air discharge mechanism 201. An opening (not explicitly shown) passes through the panel 12 from one face to the opposite face. An ICRA Class IV fire and fire and smoke dampener 203 is mounted on one face and an air diffuser 204 is coupled to the smoke dampener through the opening and mounted on the opposite face. The air discharge mechanism 201 assists in providing the required negative pressure performance functionality with respect to the partitioned space by allowing an exhaust air discharge point in the barrier wall to the public side of the barrier. A negative air machine with HEPA filtration is commonly used to exhaust through this discharge port. The smoke damper has an integral fusible link to automatically close the duct passage upon reaching a (low) predetermined temperature. FIG. 16B shows a specialized performance panel which includes an environmental monitoring mechanism 210. The environmental monitoring mechanism 210 may be a multisensor module which operates to sense one or more of differential pressure, particulate presence (multiple sizes), temperature, humidity, sound level and carbon dioxide. Alternatively, the mechanism 210 may be of simpler functionality to, for example, measure differential pressure between the occupied and container spaces. The data collected by the environmental monitoring mechanism 210 can be wirelessly communicated (using WiFi or cellular communications). A wiring pass through 212 is provided to enable data to be passed by a wired connection through the panel.

Figure 17B:
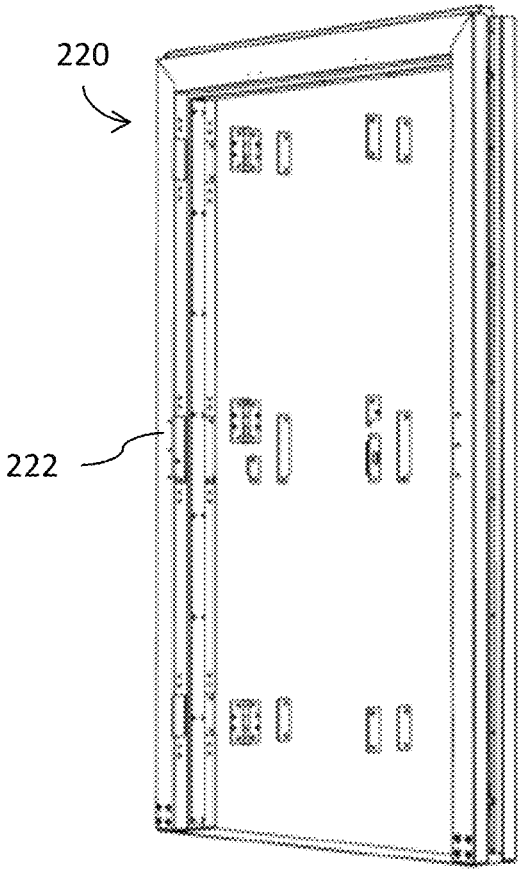
FIGS. 17A-17B are perspective views of a hinged door for the barrier.
Figure 17A:
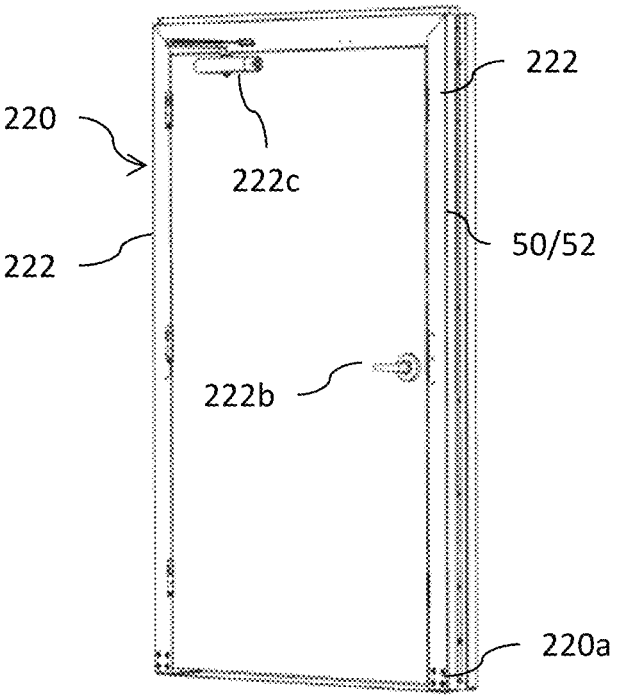

The configuration of the panels 12 for the barrier permits the design of an opening that is sized and shaped to receive a hinged door 220 as shown in FIGS. 17A-17B. To support interconnection with the panels, the frame 222 of the door 220 is provided with the same tongue and groove structure. The threshold 220*a* of the door 220 may accommodate height adjustability and a door latch 222*b* and closure assist mechanism 222*c* are provided to secure the door operation. Conventional panels of width corresponding to the door frame width are installed above the door to complete the wall section of the barrier. Alternatively, the panels may be integrated with the door and frame as a unit. Details of the frame 222 are shown in FIG. 17B. The frame 22 is configured to support a four possible directional installations (i.e., hinge left forward open, hinge left reverse open, hinge right forward open, and hinge right reverse open). The side frames include mounting opening for hinges and strike plates on both the left and right frame sides, as well as on the front and back sides of the door jam for each frame side.

Figure 17C:
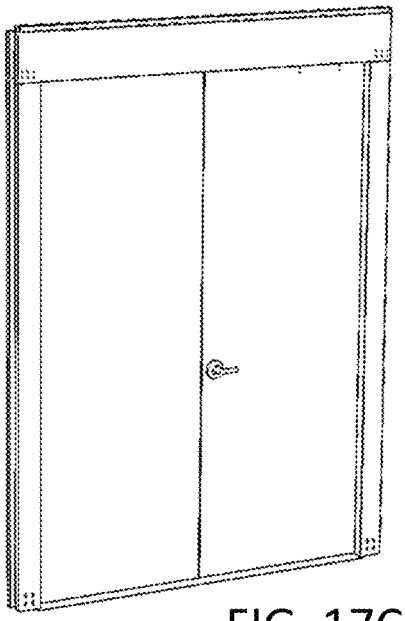
FIG. 17C shows an alternative hinged double door for the barrier.

It will be noted that as an alternative to using a single door installed from one side of the frame 220, a pair of doors could instead be used with each door hinged to one side of the frame 220 as shown in FIG. 17C.

While the invention has been illustrated and described in detail in the drawings and foregoing description, such illustration and description are considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

What is claimed is:

1. A barrier system for partitioning a space, comprising:

a plurality of interlocking panels forming a barrier;

wherein the interlocking panels are assembled laterally adjacent to each other in the barrier;

wherein a connection of laterally adjacent interlocking panels in the barrier is made through a joint formed by a tongue and groove assembly;

wherein the tongue and groove assembly comprises:

on a first interlocking panel, a latch plate and a connector mounted to the latch plate which includes a head; and on a second interlocking panel, a strike plate including a slot with an end having a wider opening configured to receive the head and a middle having a narrower opening configured to engage the head;

wherein each interlocking panel comprises:

a peripheral frame;

opposed steel side faces mounted to the peripheral frame; and an insulation block filling an interior space delimited by the peripheral frame and the opposed steel side faces;

wherein the peripheral frame comprises a first member configured to form a tongue member and a second member configured to form a groove member;

wherein the first member comprises a stack of strips including a first strip extending between the opposed steel side faces and at least one second strip mounted longitudinally centered on the first strip to form the tongue member of said tongue and groove assembly; and wherein said at least one second strip includes an opening for mounting the strike plate.

2. The barrier system of claim 1 , wherein the strike plate includes a mounting portion in a first plane and a recessed portion in a second plane offset from the first plane.

3. The barrier system of claim 1, wherein the peripheral frame is made of a thermally insulative material.

4. The barrier system of claim 3, wherein thermally insulative material is Magnesium Oxide.

5. The barrier system of claim 1, wherein the tongue member formed by the first member of the first interlocking panel is configured to engage the groove member of the second interlocking panel, and wherein the groove member formed by the second member of the second interlocking panel is configured to receive the tongue member of first interlocking panel.

6. The barrier system of claim 1, wherein the second member comprises a stack of strips including a first strip extending between the opposed steel side faces, at least a second member mounted longitudinally at one edge of the first strip and at least a third member mounted longitudinally at another edge of the first strip, wherein said second and third strips form said groove member of said tongue and groove assembly.

7. The barrier system of claim 1, wherein first member has a cross-section in a T-shape, and wherein the opposed steel side faces wrap onto sides and surfaces of the T-shape cross-section of the first member.

8. A barrier system for partitioning a space, comprising:
- a plurality of interlocking panels forming a barrier;
- wherein the interlocking panels are assembled laterally adjacent to each other in the barrier;
- wherein a connection of laterally adjacent interlocking panels in the barrier is made through a joint formed by a tongue and groove assembly;
- wherein the tongue and groove assembly comprises:
  - on a first interlocking panel, a latch plate and a connector mounted to the latch plate which includes a head; and
  - on a second interlocking panel, a strike plate including a slot with an end having a wider opening configured to receive the head and a middle having a narrower opening configured to engage the head;
- wherein each interlocking panel comprises:
  - a peripheral frame;
  - opposed steel side faces mounted to the peripheral frame; and
  - an insulation block filling an interior space delimited by the peripheral frame and the opposed steel side faces;
- wherein the peripheral frame comprises a first member configured to form a tongue member and a second member configured to form a groove member;
- wherein the second member comprises a stack of strips including a first strip extending between the opposed steel side faces, at least a second member mounted longitudinally at one edge of the first strip and at least a third member mounted longitudinally at another edge of the first strip, wherein said second and third strips form a groove member of said tongue and groove assembly; and
- wherein said first strip includes an opening, located between the second and third strips, for mounting the latch plate.

9. The barrier system of claim 8, wherein the connector is formed by a threaded shaft extending from the head, and wherein the latch plate includes a threaded opening configured to threadedly engage the threaded shaft.

10. The barrier system of claim 8, wherein the connector is formed by a shaft extending from the head, and wherein the shaft extends from and is mounted to the latch plate.

11. The barrier system of claim 8, wherein said first member comprises a stack of strips including a first strip extending between the opposed steel side faces and at least one second strip mounted longitudinally centered on the first strip to form said tongue member of said tongue and groove assembly.

12. The barrier system of claim 8, wherein the second member has a cross-section in a U-shape, and wherein the opposed steel side faces wrap onto sides and surfaces of the U-shape cross-section of the second member.

13. The interlocking panel of claim 8, wherein the peripheral frame is made of a thermally insulative material.

14. The interlocking panel of claim 13, wherein thermally insulative material is Magnesium Oxide.

15. The interlocking panel of claim 8, wherein the tongue member formed by the first member is configured to engage a groove member of another interlocking panel, and wherein the groove member formed by the second member is configured to receive a tongue member of another interlocking panel.

16. A barrier system for partitioning a space, comprising:
- a plurality of interlocking panels forming a barrier;
- wherein the interlocking panels are assembled laterally adjacent to each other in the barrier;
- wherein a connection of laterally adjacent interlocking panels in the barrier is made through a joint formed by a tongue and groove assembly;
- wherein the tongue and groove assembly comprises:
  - on a first interlocking panel, a latch plate and a connector mounted to the latch plate which includes a head; and
  - on a second interlocking panel, a strike plate including a slot with an end having a wider opening configured to receive the head and a middle having a narrower opening configured to engage the head;
- wherein each interlocking panel comprises:
  - a peripheral frame;
  - opposed steel side faces mounted to the peripheral frame; and
  - an insulation block filling an interior space delimited by the peripheral frame and the opposed steel side faces;
- wherein the insulation block filling the interior space comprises:
  - a first insulation layer;
  - a second insulation layer;
  - a radiant barrier layer sandwiched between the first and second insulation layers; and
  - a plurality of coil anchors, wherein each coil anchor is configured to pass through the radiant barrier layer and join the first and second insulation layers to each other.

17. The barrier system of claim 16, wherein the first and second insulation layers are mineral wool layers.

18. The barrier system of claim 16, wherein the radiant barrier layer is an aluminum layer.

19. The barrier system of claim 16, wherein the plurality of coil anchors are positioned within the insulation block at locations arranged in an array.

20. A barrier system for partitioning a space, comprising:
- a plurality of interlocking panels forming a barrier;
- wherein the interlocking panels are assembled laterally adjacent to each other in the barrier;

wherein a connection of laterally adjacent interlocking panels in the barrier is made through a joint formed by a tongue and groove assembly;

wherein the tongue and groove assembly comprises:

on a first interlocking panel, a latch plate and a connector mounted to the latch plate which includes a head; and on a second interlocking panel, a strike plate including a slot with an end having a wider opening configured to receive the head and a middle having a narrower opening configured to engage the head; and a floor module configured to seal against a floor and receive a bottom edge of the interlocking panels, wherein the floor module is made of two telescoping brackets, each bracket including a base and opposed sides, and wherein the base includes a cut line laterally extending between the opposed sides, and wherein the opposed sides include perforation lines that are aligned with the cut line, said cut and perforation lines configured to permit trimming of a length of the floor module.

21. The barrier system of claim 20, wherein ends of the opposed sides include fold overs.

22. A barrier system for partitioning a space, comprising:

a plurality of interlocking panels forming a barrier;

wherein the interlocking panels are assembled laterally adjacent to each other in the barrier;

wherein a connection of laterally adjacent interlocking panels in the barrier is made through a joint formed by a tongue and groove assembly;

wherein the tongue and groove assembly comprises:

on a first interlocking panel, a latch plate and a connector mounted to the latch plate which includes a head; and on a second interlocking panel, a strike plate including a slot with an end having a wider opening configured to receive the head and a middle having a narrower opening configured to engage the head; and an interface module configured to seal against a structure and receive an edge of at least one of the interlocking panels, wherein the interface module is made of two telescoping sections, each section including a bottom member and a wall member, and wherein the bottom member includes a cut line laterally extending across the bottom member, and wherein the wall member includes a perforation line laterally extending across the wall member, wherein said cut line and perforation line are aligned with each other, and wherein said cut and perforation lines are configured to permit trimming of a length of the interface module.

23. The barrier system of claim 22, wherein the structure is one of a wall or a soffit.

24. A barrier system for partitioning a space, comprising:

a plurality of interlocking panels forming a barrier;

wherein the interlocking panels are assembled laterally adjacent to each other in the barrier;

wherein a connection of laterally adjacent interlocking panels in the barrier is made through a joint formed by a tongue and groove assembly;

wherein the tongue and groove assembly comprises:

on a first interlocking panel, a latch plate and a connector mounted to the latch plate which includes a head; and on a second interlocking panel, a strike plate including a slot with an end having a wider opening configured to receive the head and a middle having a narrower opening configured to engage the head; and an interface module configured to seal against a structure and receive an edge of at least one of the interlocking panels, wherein the interface module is made of two telescoping sections, each section including a bottom member and a wall member, and wherein the wall member of a first section of said two telescoping sections has an edge with a fold over with a gap and wherein the wall member of a second section of said two telescoping sections has an edge, and wherein the edge of the wall member of the second section slides within the gap of the fold over to support telescoping of the first and second sections.

25. A barrier system for partitioning a space, comprising:

a plurality of interlocking panels forming a barrier;

wherein the interlocking panels are assembled laterally adjacent to each other in the barrier;

wherein a connection of laterally adjacent interlocking panels in the barrier is made through a joint formed by a tongue and groove assembly;

wherein the tongue and groove assembly comprises:

on a first interlocking panel, a latch plate and a connector mounted to the latch plate which includes a head; and on a second interlocking panel, a strike plate including a slot with an end having a wider opening configured to receive the head and a middle having a narrower opening configured to engage the head; and an interface module configured to seal against a structure and receive an edge of at least one of the interlocking panels, wherein the interface module is made of two telescoping sections, each section including a bottom member and a wall member, and wherein the face member includes a perforation line laterally extending across the wall face, and wherein said perforation line is configured to permit trimming of a length of the interface module.

26. A barrier system for partitioning a space, comprising:

a plurality of interlocking panels forming a barrier;

wherein the interlocking panels are assembled laterally adjacent to each other in the barrier;

wherein a connection of laterally adjacent interlocking panels in the barrier is made through a joint formed by a tongue and groove assembly;

wherein the tongue and groove assembly comprises:

on a first interlocking panel, a latch plate and a connector mounted to the latch plate which includes a head; and on a second interlocking panel, a strike plate including a slot with an end having a wider opening configured to receive the head and a middle having a narrower opening configured to engage the head; and an interface module configured to seal against a structure and receive an edge of at least one of the interlocking panels, wherein the interface module is made of two telescoping sections, each section including a bottom member and a wall member, and wherein the face member of a first section of said two telescoping sections has an edge with a fold over with a gap and wherein the face member of a second section of said two telescoping sections has an edge, and wherein the edge of the face member of the second section slides within the gap of the fold over to support telescoping of the first and second sections.

27. An interlocking panel for use in a barrier system for partitioning a space, comprising:

a peripheral frame;

opposed steel side faces mounted to the peripheral frame; and an insulation block filling an interior space delimited by the peripheral frame and the opposed steel side faces;

wherein the peripheral frame includes a tongue and groove assembly comprising:

on a first edge of the interlocking panel, a latch plate and a connector mounted to the latch plate which includes a head; and on a second edge of the interlocking panel, a strike plate including a slot with an end having a wider opening configured to receive the head and a middle having a narrower opening configured to engage the head;

wherein the peripheral frame comprises a first member configured to form a tongue member and a second member configured to form a groove member;

wherein first member comprises a stack of strips including a first strip extending between the opposed steel side faces and at least one second strip mounted longitudinally centered on the first strip to form the tongue member of said tongue and groove assembly; and wherein said at least one second strip includes an opening for mounting the strike plate.

28. The interlocking panel of claim 27, wherein the second member comprises a stack of strips including a first strip extending between the opposed steel side faces, at least a second member mounted longitudinally at one edge of the first strip and at least a third member mounted longitudinally at another edge of the first strip, wherein said second and third strips form the groove member of said tongue and groove assembly.

29. An interlocking panel for use in a barrier system for partitioning a space, comprising:

a peripheral frame;

opposed steel side faces mounted to the peripheral frame; and an insulation block filling an interior space delimited by the peripheral frame and the opposed steel side faces;

wherein the peripheral frame includes a tongue and groove assembly comprising:

on a first edge of the interlocking panel, a latch plate and a connector mounted to the latch plate which includes a head; and on a second edge of the interlocking panel, a strike plate including a slot with an end having a wider opening configured to receive the head and a middle having a narrower opening configured to engage the head;

wherein the peripheral frame comprises a first member configured to form a tongue member and a second member configured to form a groove member;

wherein the second member comprises a stack of strips including a first strip extending between the opposed steel side faces, at least a second member mounted longitudinally at one edge of the first strip and at least a third member mounted longitudinally at another edge of the first strip, wherein said second and third strips form the groove member of said tongue and groove assembly; and wherein said first strip includes an opening, located between the second and third strips, for mounting the latch plate.

30. The barrier system of claim 27, wherein first member has a cross-section in a T-shape, and wherein the opposed steel side faces wrap onto sides and surfaces of the T-shape cross-section of the first member.

31. The barrier system of claim 29, wherein the second member has a cross-section in a U-shape, and wherein the opposed steel side faces wrap onto sides and surfaces of the U-shape cross-section of the second member.

32. An interlocking panel for use in a barrier system for partitioning a space, comprising:

a peripheral frame;

opposed steel side faces mounted to the peripheral frame; and an insulation block filling an interior space delimited by the peripheral frame and the opposed steel side faces;

wherein the peripheral frame includes a tongue and groove assembly comprising:

on a first edge of the interlocking panel, a latch plate and a connector mounted to the latch plate which includes a head; and on a second edge of the interlocking panel, a strike plate including a slot with an end having a wider opening configured to receive the head and a middle having a narrower opening configured to engage the head;

wherein the insulation block filling the interior space comprises:

a first insulation layer;

a second insulation layer; and a radiant barrier layer sandwiched between the first and second insulation layers; and wherein the insulation block further includes a plurality of coil anchors, wherein each coil anchor is configured to pass through the radiant barrier layer and join the first and second insulation layers to each other.

33. The interlocking panel of claim 32, wherein the plurality of coil anchors are positioned within the insulation block at locations arranged in an array.

* * * * *